US008387531B2

(12) United States Patent
Honer et al.

(10) Patent No.: US 8,387,531 B2
(45) Date of Patent: Mar. 5, 2013

(54) IMPACT SENSING SWITCH

(75) Inventors: Kenneth Allen Honer, Santa Clara, CA (US); Rolfe Tyson Gustus, Santa Clara, CA (US); Ilyas Mohammed, Santa Clara, CA (US)

(73) Assignee: Tessera, Inc., San Jose, CA (US)

( * ) Notice: Subject to any disclaimer, the term of this patent is extended or adjusted under 35 U.S.C. 154(b) by 937 days.

(21) Appl. No.: 12/072,687

(22) Filed: Feb. 27, 2008

(65) Prior Publication Data

US 2008/0217144 A1 Sep. 11, 2008

Related U.S. Application Data

(60) Provisional application No. 60/904,027, filed on Feb. 28, 2007.

(51) Int. Cl.
*F42C 19/06* (2006.01)

(52) U.S. Cl. ..... 102/216; 200/61.45 R

(58) Field of Classification Search ..... 102/216; 200/552, 553, 220, 61.5–61.52, 277, 276.1, 200/61.45 R
See application file for complete search history.

(56) References Cited

U.S. PATENT DOCUMENTS 1,662,979 A * 3/1928 Nelson ..... 200/61.52
3,560,680 A * 2/1971 Clarke ..... 200/61.45 R
3,731,020 A * 5/1973 York ..... 200/61.45 R
3,816,680 A * 6/1974 Suzuki et al. ..... 200/61.51
3,927,286 A * 12/1975 Fohl ..... 200/61.45 R
4,022,998 A 5/1977 Fohl et al.
4,060,004 A 11/1977 Scholz et al.
4,097,698 A 6/1978 Jackman et al.
4,174,666 A 11/1979 Lucey, Jr. et al.
4,178,492 A * 12/1979 Roesch et al. ..... 200/61.45 R
5,006,676 A * 4/1991 Bogut et al. ..... 200/61.52
5,134,255 A * 7/1992 Tetrault et al. ..... 200/61.45 R
5,177,331 A 1/1993 Rich et al.
5,237,135 A * 8/1993 Wolski ..... 200/61.45 R
5,597,066 A * 1/1997 Burmester ..... 200/292
5,987,988 A * 11/1999 Kunimi et al. ..... 73/514.01
6,005,205 A * 12/1999 Chou ..... 200/61.45 M
6,064,013 A 5/2000 Robinson
6,518,523 B1 * 2/2003 Chou ..... 200/61.52
6,765,160 B1 7/2004 Robinson
7,019,231 B2 3/2006 Ishikawa et al.

* cited by examiner

*Primary Examiner* — Michael Carone
*Assistant Examiner* — Reginald Tillman, Jr.
(74) *Attorney, Agent, or Firm* — Lerner, David, Littenberg, Krumholz & Mentlik, LLP

(57) ABSTRACT

An impact switch includes a housing having a wall including at least two electrically conductive contact elements spaced apart from one another. The switch includes an inertial body having a conductive surface disposed in a tapered aperture and electrically connecting the contact elements to one another in a switch closed condition. An impact switch for rapidly firing an explosive device is provided.

9 Claims, 20 Drawing Sheets

IMPACT SENSING SWITCH

This application claims the benefit of the filing date of U.S. Provisional Patent Application No. 60/904,027 filed Feb. 28, 2007, the disclosure of which is hereby incorporated herein by reference.

BACKGROUND OF THE INVENTION

The present invention relates to impact sensing switches including impact sensing switches mounted on projectiles and a method for triggering devices by interrupting an electrical path.

Impact sensing switches and triggering devices are commonly utilized in a wide variety of applications such as triggering airbag deployment in automobiles. Standard impact switches are often too large in size such that they may not fit in applications which have limited space requirements. Many impact sensing switches are relatively slow in triggering a device because the configuration requires connection of an electrical path. Further, common impact sensing switches cannot withstand harsh gravity induced shock loading and are inoperable in high gravity or high shock load environments.

The present invention solves these difficult problems in a novel manner by improving the overall performance of impact sensing switches. Smaller, faster triggering, robust impact sensing switches are disclosed herein.

SUMMARY OF THE INVENTION

In one aspect of the invention, a switch has a housing having a wall. The wall can define a tapered aperture having a wide end facing in a forward direction. The wall may include at least two electrically conductive contact elements spaced apart from one another and an inertial body having a conductive surface. The inertial body may be disposed in the tapered aperture. The inertial body may engage the contact elements and electrically connects the contact elements to one another in a switch-closed condition. The inertial body can be dislodged from engagement with at least one of the contact elements upon deceleration of the housing in the forward direction.

In another aspect of the invention, a switch has a housing defining a chamber. The chamber has an axis extending forwardly and rearwardly and a peripheral region remote from the axis. First and second contact elements may be exposed in the peripheral region of the chamber. An electrically conductive liquid can be disposed within the chamber. The chamber and the contact elements are configured so that during rotation of the switch about the axis, the conductive liquid can form a ring around the axis in the peripheral region and electrically connects the contacts to one another. Upon deceleration of the housing in the forward direction, the liquid may be displaced away from the contact elements.

In another aspect of the invention, a switch has a housing defining a rearward chamber and a forward chamber connected by an aperture. First and second contact elements may be exposed in the rearward chamber. An electrically conductive liquid can be disposed within the rearward chamber. The chamber and contact elements are configured so that in a switch closed condition the conductive liquid electrically can connect the contacts to one another. The liquid can be displaced through the aperture into the forward chamber and away from at least one of the contact elements upon deceleration of the housing in a forward direction.

In another aspect of the invention, a switch has a housing defining a chamber. The housing has an axis extending forwardly and rearwardly. A rearward magnetic element can be fixed to the housing. A rearward contact may be exposed in the chamber. A flexible member can have a fixed portion attached to the housing and a movable portion. A mobile magnetic element may be carried on the movable portion of the flexible member. A mobile contact may be carried on the movable portion of the flexible member and disposed forwardly of the rearward contact. The magnetic elements can attract one another and hold the contacts in engagement with one another in a switch closed condition. The mobile contact and the movable portion of the flexible member can move forwardly away from the rearward contact upon deceleration of the housing in the forward direction.

In yet another aspect of the invention, a switch has a housing defining a chamber. The housing can have a rearward wall, a forward wall and an axis extending forwardly and rearwardly. A rearward contact may be exposed in the chamber. A flexible member can have a fixed portion attached to the housing and a movable portion. A mobile contact may be connected to the movable portion of the flexible member and can be disposed forwardly of the rearward contact. A tacky adhesive region may be disposed on the forward wall. An inertial body can be carried on the movable portion of the flexible member. The flexible member can urge the mobile contact and the inertial body rearwardly so that the mobile contact may engage the rearward contact in a switch-closed condition. The inertial body, the mobile contact and the movable portion of the flexible member can move forwardly away from the rearward contact so that at least one of the inertial body, the mobile contact and the movable portion of the flexible member may be adhered to the tacky adhesive region upon deceleration of the housing in the forward direction. The adhesive region can hold the mobile contact away from the rearward contact in a tripped condition.

In still another aspect of the present invention, a switch having a structure has an axis extending forwardly and rearwardly. The structure can include walls defining a forward chamber and a rearward chamber communicating with the forward chamber. A first contact element may be exposed in the rearward chamber and may form at least a portion of a wall of the rearward chamber. A second contact element may extend at least partially within the rearward chamber and abut the first contact element in a switch-closed condition. The second contact element can be dislodged from engagement with the first contact element, can move out of the rearward chamber and can be trapped in the forward chamber upon deceleration of the structure in a forward direction.

In yet another aspect of the present invention, a switch has a housing having an axis extending forwardly and rearwardly. The housing can have a forward-facing rear wall and a tapered aperture. The aperture may have a first side wall sloping away from the axis in the rearward direction. The first side wall can include at least one electrically conductive contact element and the rear wall can include at least one electrically conductive contact element. An inertial body having a conductive surface can be disposed in the tapered aperture. The inertial body can engage the contact elements during rotation of the switch about the axis and can electrically connect the contact elements to one another in a switch closed condition. The inertial body can be dislodged from engagement with at least one of the contact elements upon deceleration of the housing in a forward direction.

In still another aspect of the invention, a switch has a housing having substantially vertical walls forming an aperture. The aperture can have a forward end facing in a forward direction and a rearward end facing in a rearward direction. A first resilient contact element can be physically attached to the forward end of the housing. A second contact element may be physically attached to the rearward end of the housing. An inertial body having a conductive surface can be disposed in the aperture between the contact elements. The inertial body may engage the contact elements and electrically connect the contact elements to one another in a switch closed condition. The inertial body may be dislodged from engagement with at least one of the contact elements upon deceleration of the housing in forward direction.

In still another aspect of the invention, a device can be triggered by accelerating a switch comprising a conductive mass disposed between at least two contacts; forming an electrical path through the conductive mass and between the contacts; decelerating the switch; interrupting the electrical path; and triggering the device.

The Summary is not intended nor should it be construed as being representative of the full extent and scope of the present invention, which additional aspects will become more readily apparent from the detailed description, particularly when taken together with the appended drawings.

DETAILED DESCRIPTION

Figure 1:
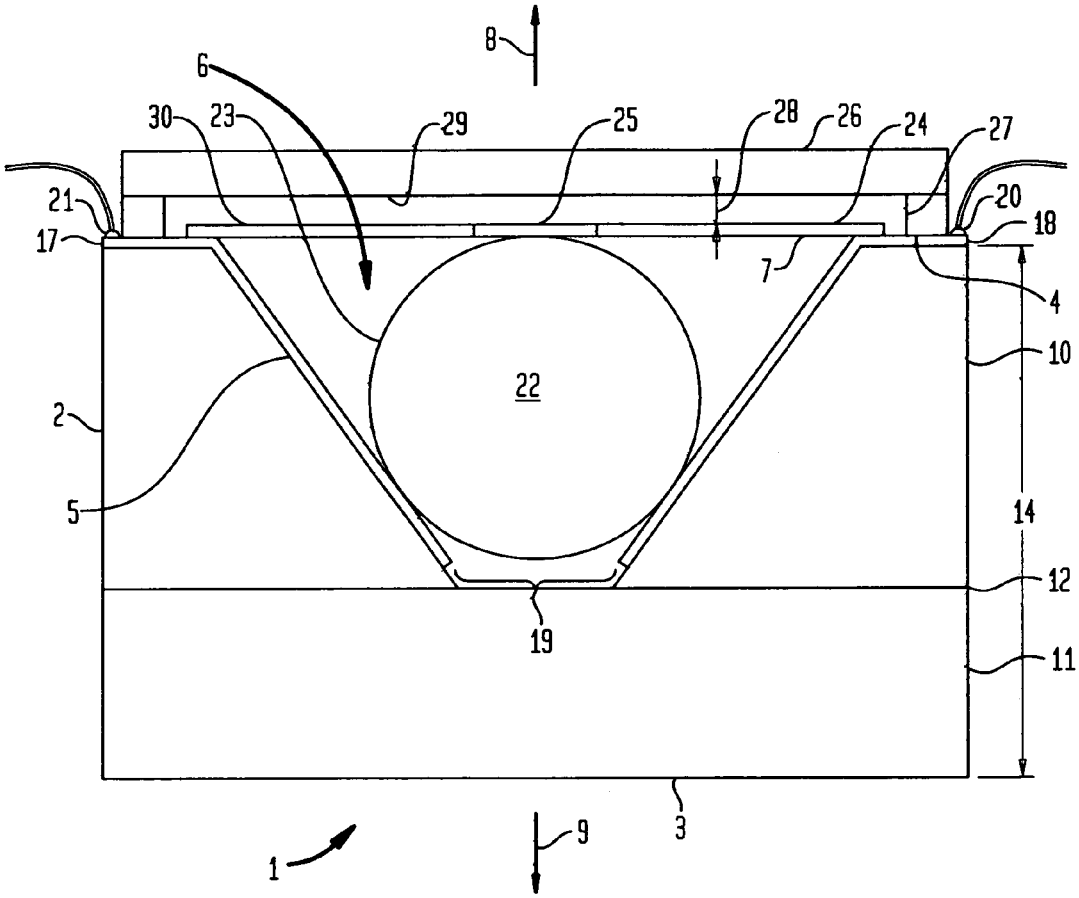
FIG. 1 is a cross-sectional view of a switch according to one embodiment of the present invention in a switch closed position.

Switch 1 in accordance with one embodiment of the present invention includes a housing 2. (FIGS. 1-3) Housing 2 has a rearward surface 3 and a forward surface 4. The housing also has walls 5 defining a tapered aperture 6. The aperture 6 has a wide end 7 facing in a forward direction 8 and away from a rearward direction 9. The wide end 7 of the aperture 6 is open to the forward surface 4 of the housing 2.

The housing 2 includes a top portion 10 and a bottom portion 11. The top portion 10 is bonded-rearwardly to bottom portion 11 with, for example, an adhesive material 12. The housing 2 is fabricated from a semiconductor chip. Preferably, the top portion 10 and the bottom portion 11 materials have similar linear coefficients of thermal expansion to minimize internal stress under changing temperature conditions and maintain dimensional stability. Optionally, the top portion 10 of the housing 2 is a semiconductor chip, which is bonded rearwardly with an adhesive 12 to the bottom portion 11, which is a glass reinforced circuit board or another composite material.

The tapered aperture 6 is formed in the top portion 10 using conventional chemical or mechanical material removal methods such as chemical etching or mechanical machining. For example, numerous housings can be fabricated as portions of a silicon wafer. Preferably, the housing 2 has dimensions about 2 millimeters or less in forward to rearward thickness dimension 14 and is no larger than about 3 millimeters in the length dimension 15 and the width dimension 16. (FIGS. 1-3).

The aperture 6 has flat walls 5 forming the frustum of a pyramid with the truncated end facing rearwardly 9. While FIGS. 2-3 depict the tapered aperture 6 with four flat walls 5, the aperture 6 may contain any number of flat or curved walls.

Wall 5 includes at least two electrically conductive contact elements 17 and 18 spaced apart from one another. Contacts 17 and 18 are conductive layers disposed on wall 5 of the housing 2. The contacts 17, 18 may comprise a metallic layer or layers such as copper, tungsten, gold, silver, platinum conductive metal oxides, and nitrides and combinations thereof. Contacts 17 and 18 are disposed on the housing so that the elements are separated from one another by at least one non-conductive spacer region 19. The contacts 17, 18 and the spacer region 19 may be formed by manufacturing techniques used in production of semi-conductor wafers such as masking, etching, chemical vapor deposition (CVD), sputtering and selective plating.

Figure 2:
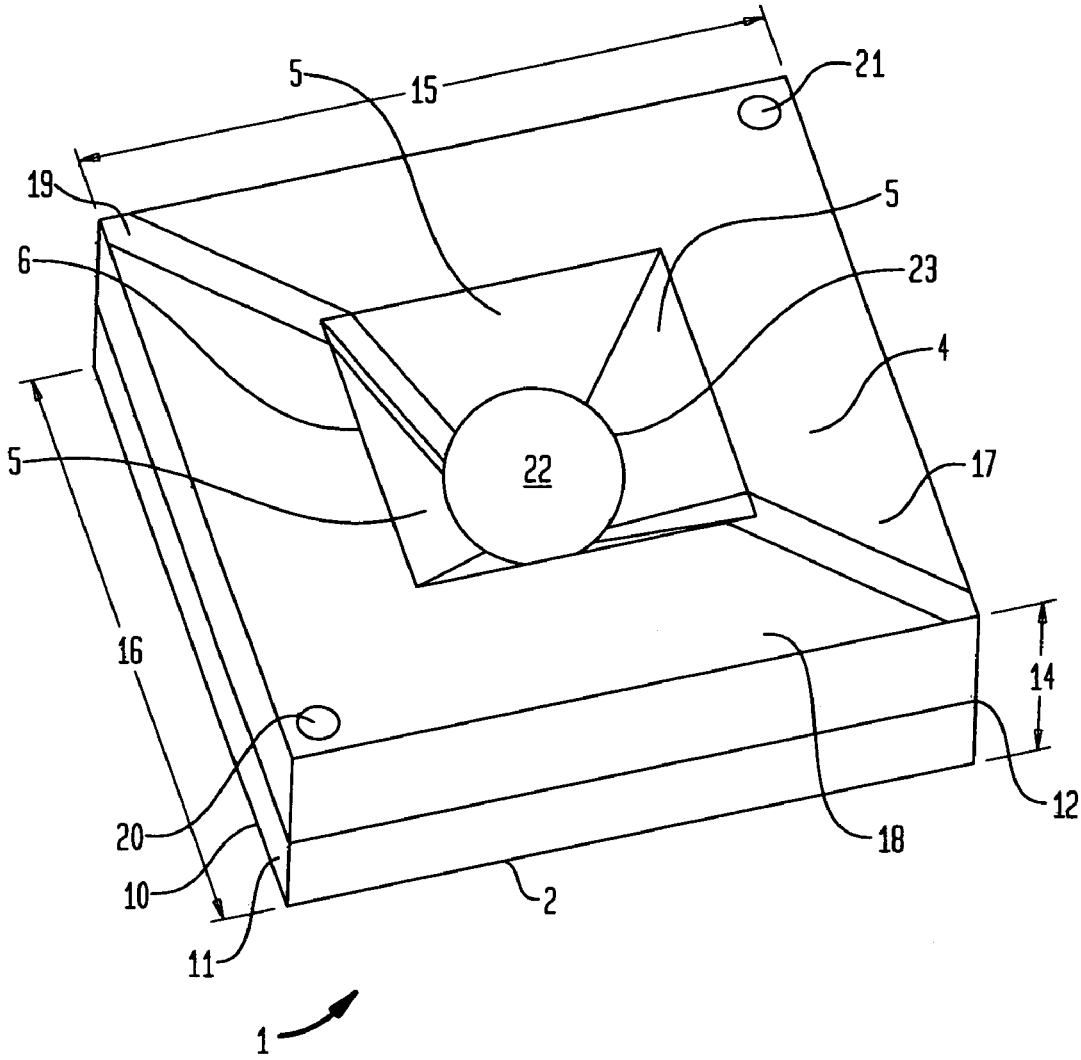
FIG. 2 is an isometric view of some of the elements included in the switch of FIG. 1.
Figure 3:
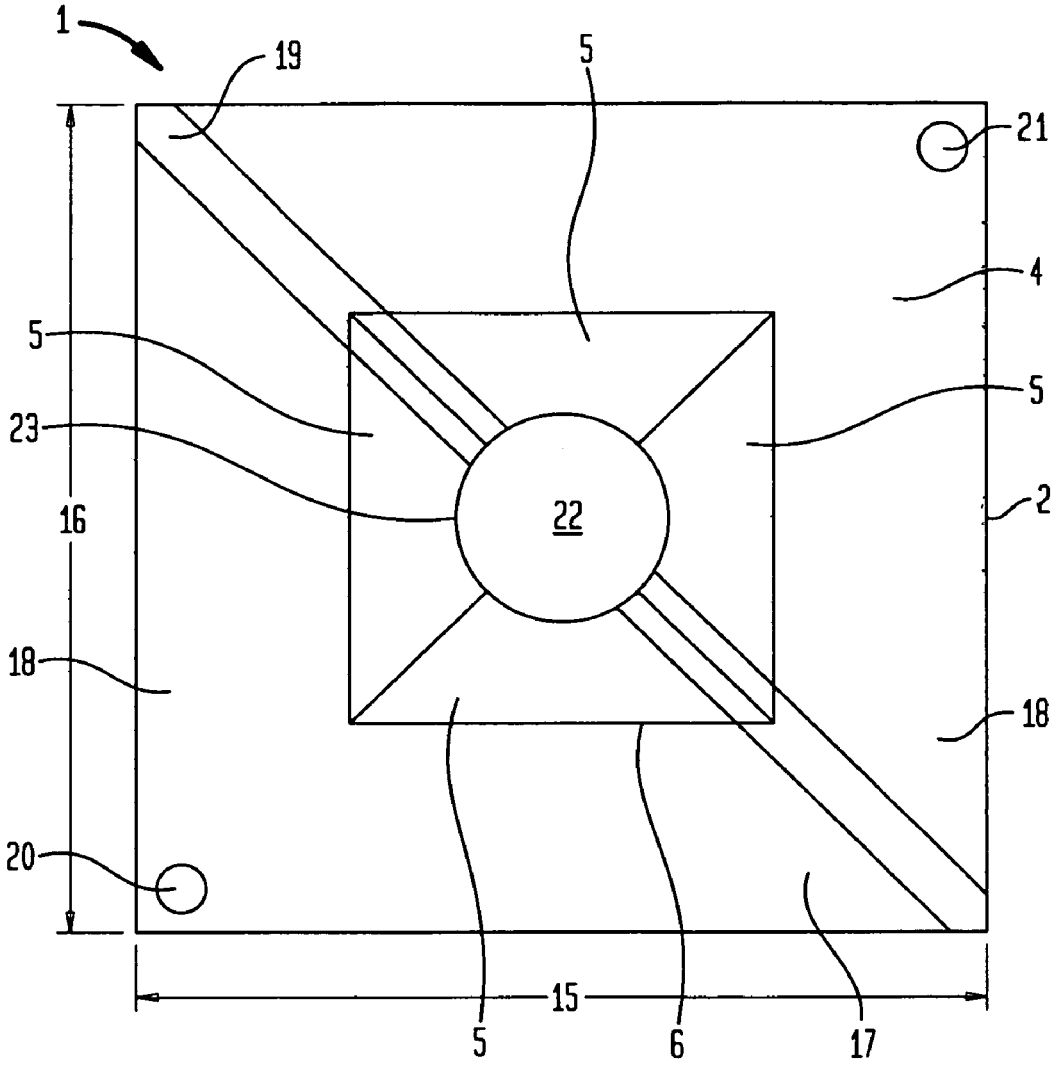
FIG. 3 is a forward facing plan view of some of the elements included in the switch of FIG. 1.

In a preferred geometry, contacts 17 and 18 cover the forward facing surface 4 of the housing 2 including the walls 5 except in the spacer region 19 (FIGS. 2-3). Bond pads 20 and 21 are bonded with a conductive adhesive to contacts 17 and 18 at any convenient location on the housing 2. Preferably, bond pads 20 and 21 are located near the periphery of the housing 2 and outside of the tapered aperture 6. Any number of bond pads may be utilized at any location on the contacts.

The switch also includes an inertial body 22 having an electrically conductive surface 23. In this embodiment, the conductive surface 23 is formed as a coating on the inertial body by conventional metallization methods such as plating, CVD and sputtering. The conductive surface 23 on inertial body 22 may be made of an electrically conductive material such as copper, gold, silver, tungsten, conductive metallic oxides, nitrides and combinations thereof. Alternatively, the inertial body may be a uniform body of electrically conductive material such as a conductive metal. The inertial body 22 is disposed in the tapered aperture 6 of the housing 2.

Switch 1 further includes a flexible member 24 mechanically connected to the housing 2. The flexible member 24 may be bonded to the housing 2 using an adhesive (not shown). The flexible member overlies the forward surface 4 of the housing and the wide end 7 of the tapered aperture 6. The flexible member 24 may define at least one aperture 25.

In the present embodiment, the switch includes a lid 26. The lid is fabricated from any non-conductive rigid solid material such that the lid 26 covers the wide end 7 of the aperture 6. Preferably, the lid 26 is made of a glass and is attached to the housing with a suitable adhesive such as an epoxy, or silicone. In this embodiment, the lid 26 is mounted to the housing with an adhesive on a gasket 27. The gasket is bonded to the housing creating a seal over the wide end 7 of the tapered aperture 6 and a gap 28 between the rearward surface 29 of the lid and the forward surface 30 of the flexible member 24. The gap 28 allows forward displacement of the inertial body 22 and flexible member 24 away from the contacts 17, 18 upon deceleration of the housing 2 in the forward direction 8.

Figure 4:
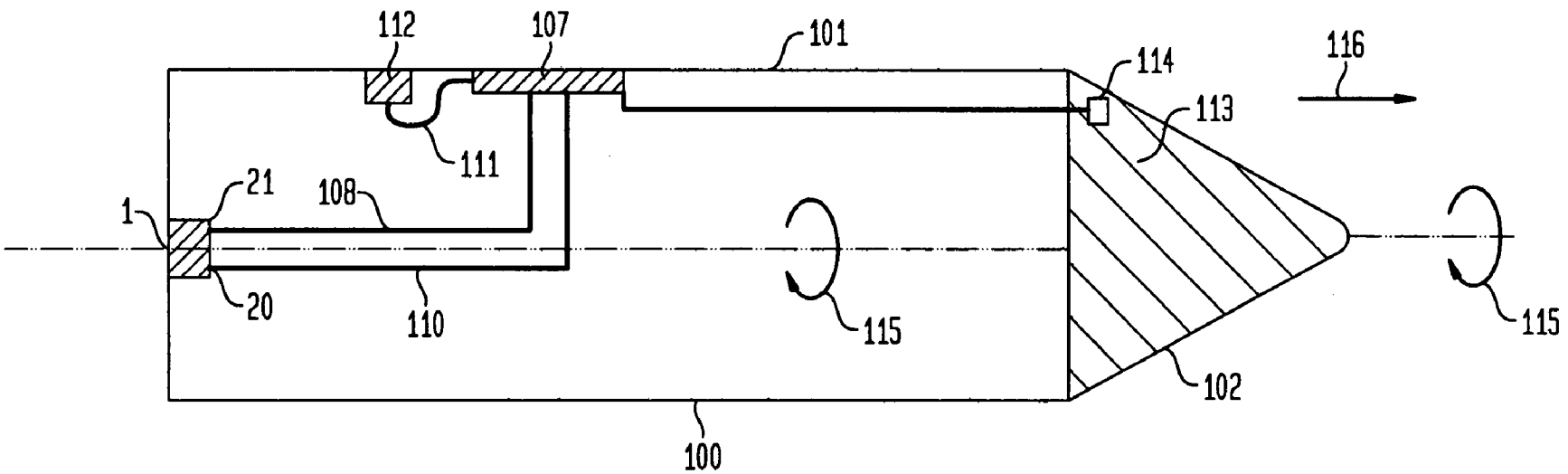
FIG. 4 is a detail view of the elements included in the switch of FIG. 1. as mounted on a projectile.

As shown in FIG. 4 the switch 1 is mounted on a projectile 100. The projectile includes a projectile body 101 having a forward end 102 and a longitudinal or forward to rearward axis 115. The projectile also includes an explosive charge 113 in proximity to a triggering device 114. The switch 1 is mounted to the projectile body 101 adjacent the longitudinal axis 115. The wide end 7 of the aperture 6 faces toward the forward end 102 of the body 101. The switch is fastened and may be bonded to the projectile body 101. A circuit 107 is mounted to the projectile body 101 and is electrically connected by connections 108 and 110 to bond pads 20 and 21 of the switch. A connector 111 connects a power source 112, such as a battery, to the circuit 107. Current flows through the circuit 107 and the switch 1 in a switch closed position.

In use, the projectile is launched in the forward direction 116 and rotates about the projectile axis 115. During flight of the projectile, the inertial body 22 is urged rearwardly 9 by the flexible member 24. During this time, the switch remains in the switch closed condition as depicted in FIG. 1. The conductive surface 23 engages contacts 17 and 18 so that current flows from the power source 112 through the circuit 107 and the switch 1. Because the switch is close to the axis 115, rotation of the projectile about the axis does not tend to move the inertial body 22 relative to the housing 2.

Upon rapid deceleration of the projectile due to impact of the projectile with an object sufficient to generate about a 100-300 g force in the forward direction 116, the inertial body 22 disengages from contacts 17 and/or 18 by moving in the forward direction 116 thus deforming flexible member 24 forwardly. The movement of the inertial body 22 away from the contacts interrupts the current flow through the switch in less than about 100 us creating a switch open condition. Upon detection of a switch open condition for about 10 μs, or a predetermined delay time, the circuit 107 triggers the explosive charge 113 through the trigger 114.

Preferably, selected material removal methods are suited for economic mass production such that a large number of switch housings 2 are fabricated simultaneously from semiconductor wafers. The wafers may be separated by conventional chip dicing methods into individual switch units.

Alternatively, other geometries of the tapered aperture 4 such as a conical tapered aperture, a flat-sided tapered aperture having any number of flat walls, or a tapered aperture having a combination of curved and flat walls may be utilized depending on the structural loading and size requirements of a particular switch application.

Optionally, the switch may include a plurality of flexible members mechanically connected to the housing. The flexible members may be attached to the housing with a suitable adhesive or mechanical fastening method as discussed above. Any number of flexible members may be employed. The flexible member or members may define one or more apertures and may be made from a wide variety of flexible materials such as polymer films, molded polymers and elastomers.

Alternatively, the lid may be mechanically fastened to the housing with retaining clips or another suitable mechanical fastening method. Optionally, the lid 26 may hermetically seal the housing 2.

In another embodiment of the present invention, as shown in FIGS. 5A-7, the switch 301 has a housing 302 defining a substantially circular chamber 303. The chamber 303 has an axis 304 extending in the forward direction show by arrow 305 and in the rearward direction show be arrow 306. The chamber has a spherical central region 307 and a peripheral region 308 remote from the axis 304. The housing includes a forward portion 309 and a rearward portion 310. Rearward facing surface 311 of forward portion 309 is bonded with an adhesive 312 to the forward facing surface 313 of the rearward portion 310.

The rearward portion defines apertures 314, 315 and 351. The forward portion 309, the rearward portion 310 and the apertures 314, 315 and 351 are formed by machining, chemical etching or other standard semiconductor manufacturing processes. In the present embodiment, the housing 302 is made of a silicon semiconductor material. Optionally, the housing may be fabricated from a wide variety of non-conductive structural materials such as engineering polymers and fiber reinforced composite materials. The housing 302 desirably has lateral dimensions 330, 331 (FIG. 6) perpendicular to axis 304 of about 3 mm or less, and may have an axial or thickness dimension 332 (FIG. 5C) of about 2 mm or less.

Figure 6:
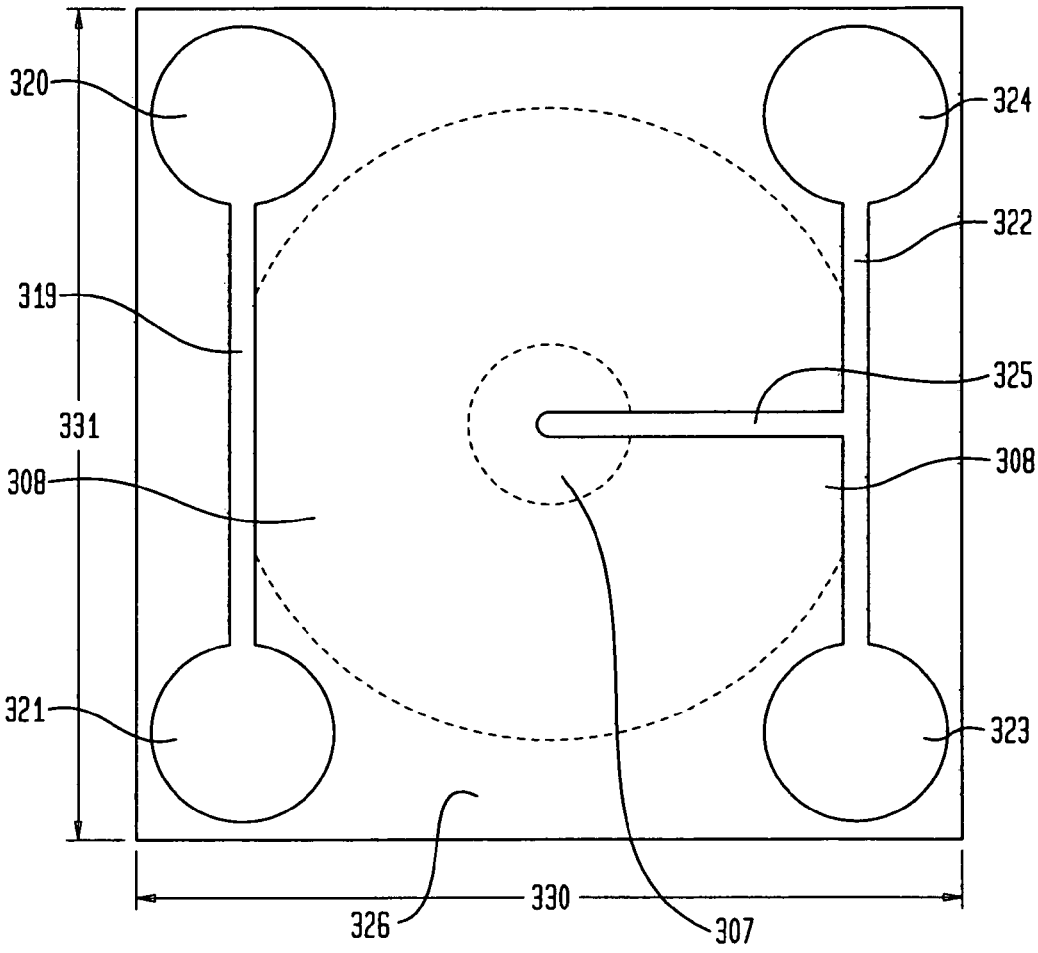
FIG. 6 is a rear plan view of some of elements included in the switch of FIG. 5A.

An electrically conductive contact element 316 fills aperture 351 and is exposed in the peripheral region 308 of the chamber 303. Likewise, an electrically conductive contact element 317 fills aperture 315 and is exposed in the peripheral region 308 of the chamber 303. Similarly, an electrically conductive contact element 318 fills aperture 314 and is exposed in the central region 307 of the chamber. A trace 319 is disposed on the rearward surface of the housing and connects terminals 320 and 321 to the peripheral region 308 (FIG. 6). A second trace 322 is disposed on the rearward surface of the housing and connects terminals 323 and 324 to peripheral region 308. A third trace 325 is disposed on the rearward surface of the housing substantially perpendicular to trace 322 and connects the central region 307 to terminals 323 and 324. The contacts and traces may comprise a metallic layer or layers such as copper, tungsten, gold, silver or platinum, conductive metal oxides, nitrides and combinations thereof. The contacts and traces may be formed by manufacturing techniques used in production of semi conductor wafers such as masking, etching, chemical vapor deposition (CVD), sputtering and selective plating.

Terminals 320 and 321 are attached to trace 319 and terminals 323 and 324 are attached to trace 322 on the rearward facing surface 326. Desirably, the terminals are attached with a conductive adhesive or solder material near the periphery of the switch. (FIG. 6).

An electrically conductive liquid 327 such as mercury (Hg) is disposed within the chamber 303. When the switch 301 is not rotating about the axis 304, (FIG. 5A) and is not accelerating or decelerating, the conductive liquid 327 is contained in the central region 307. In this switch open condition, (FIG. 5A) the conductive liquid does not touch the peripheral contacts 316, 317. Therefore, the conductive liquid does not electrically connect contacts 316 and 317 with one another. In this condition, terminals 320 and 321 are not electrically connected to terminals 323 and 324.

Figure 7:
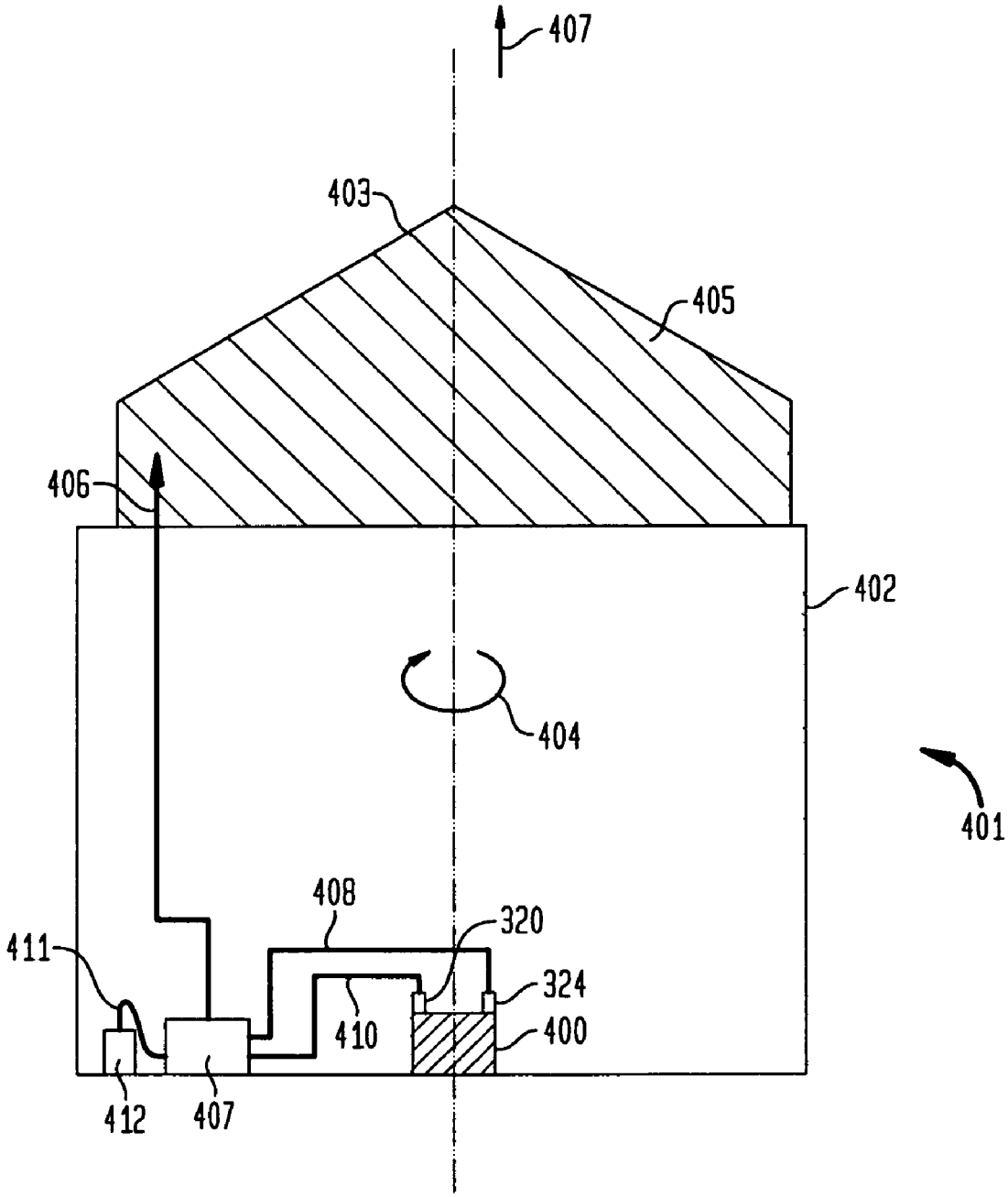
FIG. 7 is a detail view of the elements included in the switch of FIG. 5A as mounted on a projectile.

As shown in FIG. 7 the switch 400 is mounted on a projectile 401. The projectile includes a projectile body 402 having a forward end 403 and a longitudinal or forward to rearward axis 404. The projectile 401 also includes an explosive charge 405 in proximity to a triggering device 406.

The switch 400 is fastened or bonded to the projectile body 402. The switch is mounted to the projectile body substantially co-linear with the longitudinal axis 404 with the rear of the switch facing the rear of the projectile body. The axis of the switch is oriented towards and substantially aligned with the forward end 403 of the body and the axis 404 of the projectile 401. The circuit 407 is mounted to the projectile body 402 and is electrically connected by a connection 408 to at least one of terminals 323 or 324. The circuit is also connected by a connection 410 to at least one of terminals 320 or 321 of the switch. The circuit is electrically connected by a connection 411 to a power source 412, such as a battery. Current flows through the circuit 407 and the switch 400 only in a switch closed position.

Desirably, the axis 304 of the switch is mounted substantially co-linear with the axis 404 of the projectile body. The switch 400 may also be mounted adjacent to projectile axis 404 so long as the projectile axis 404 is within the width dimension 330 and the length dimension 331 of the switch (FIG. 6) and the switch axis 304 is mounted substantially collinear with the body of the projectile. The forward portion of the housing 309 faces the forward direction of the projectile as indicated by arrow 407.

Figure 5A:
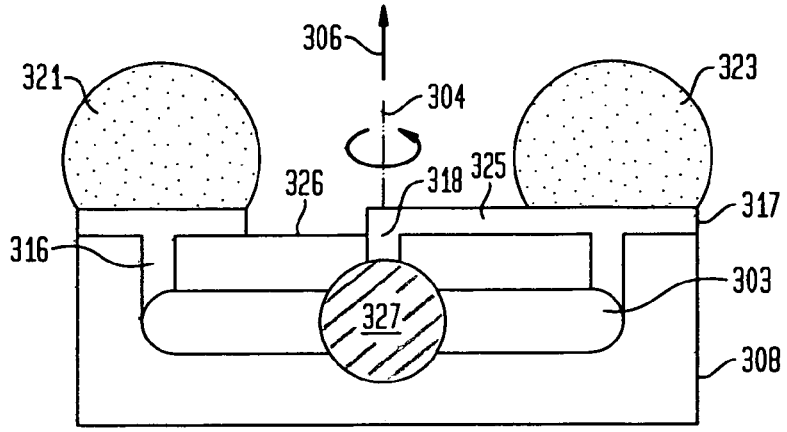
FIG. 5A is cross-sectional view of a switch according to one embodiment of the present invention in a switch open position.
Figure 5B:
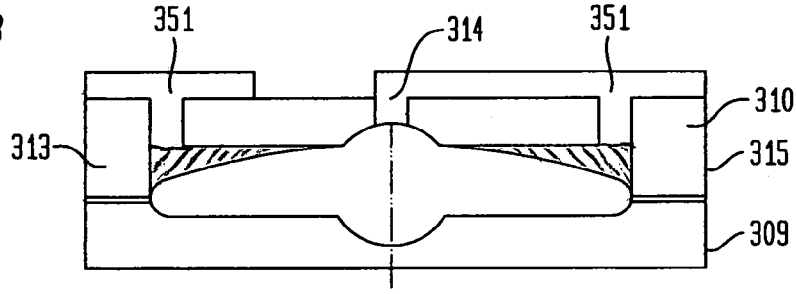
FIG. 5B is cross-sectional view of switch according FIG. 5A in a switch closed position.

In use, the projectile 401 is launched in the forward direction 407 and rotates about the axis 404. Because the switch accelerates in the forward direction 407, the conductive liquid 327 flows to the rear of the chamber as shown in FIG. 5B. Forward acceleration and rotation of the projectile forces the conductive liquid towards the rear wall and the peripheral region of the chamber. (FIG. 5B)

Figure 5C:
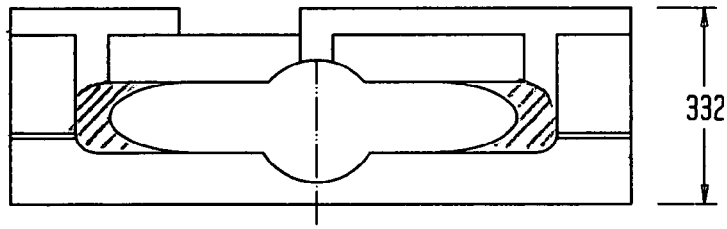
FIG. 5C is cross-sectional view of a switch according to FIG. 5A in a switch closed position.

During flight, the rotation of the projectile maintains the conductive liquid in the peripheral region 308 of the chamber 303. Gradual deceleration of the projectile during flight may cause some of the conductive liquid 327 to flow forwardly. However, the rotation of the projectile maintains a continuous ring of conductive liquid around the periphery of the chamber. During this time, the switch is in the closed condition as depicted in FIG. 5C. The conductive liquid 327 engages contacts 316 and 317 so that current flows from the power source through the circuit and the switch.

Figure 5D:
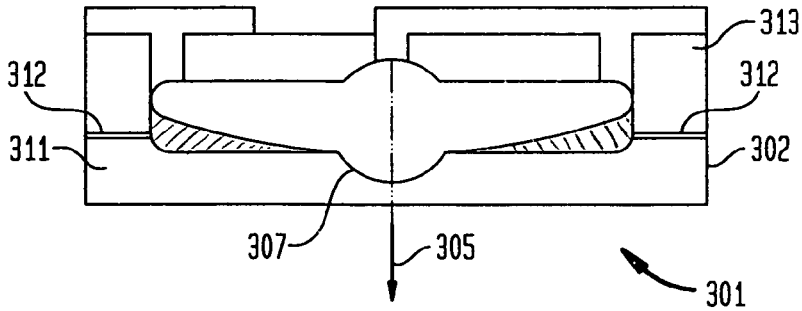
FIG. 5D is cross-sectional view of a switch according to FIG. 5A in a switch open position.

Upon rapid deceleration of the projectile due to impact of the projectile with an object sufficient to generate about a 100-300 g force in the forward direction, the conductive liquid 327 disengages from the contacts 316 or 317 by moving in the forward direction 407 (FIG. 5D). The movement of the conductive liquid away from either contact 316 or 317 interrupts the current flow through the switch in less than about 100 μs creating a switch open condition. Upon detection of a switch open condition for about 10 μs, or a predetermined delay time, the circuit 407 triggers the explosive charge 405 through the trigger 406.

Figure 8A:
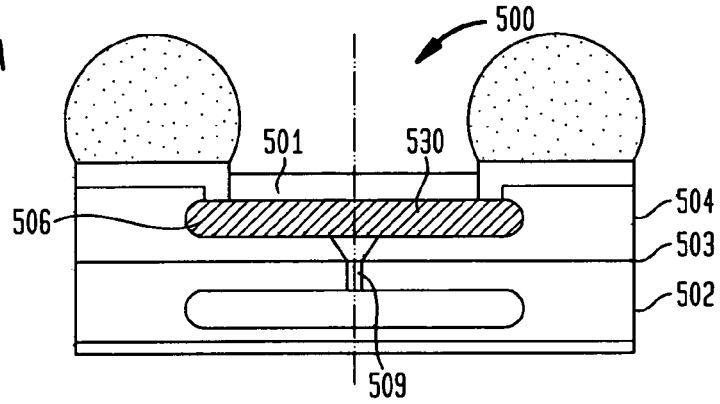
FIG. 8A is cross-sectional view of a switch according to one embodiment of the present invention in a switch closed position.
Figure 8B:
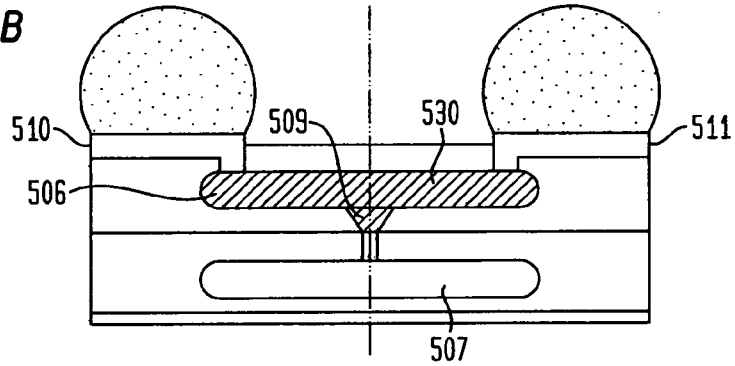
FIG. 8B is cross-sectional view of a switch according to FIG. 8A in a switch closed position.
Figure 8C:
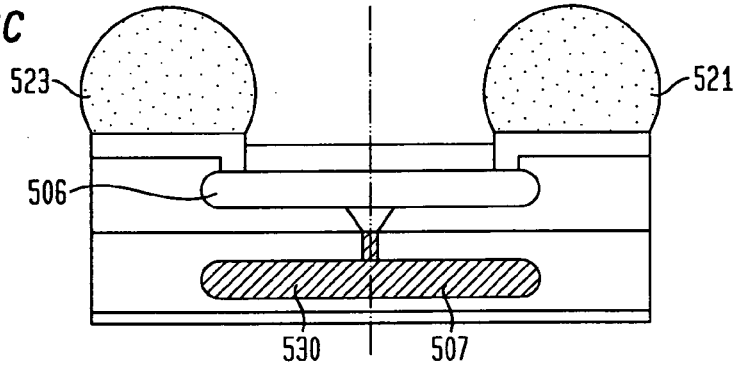
FIG. 8C is cross-sectional view of a switch according to FIG. 8A in a switch open position.
Figure 8D:
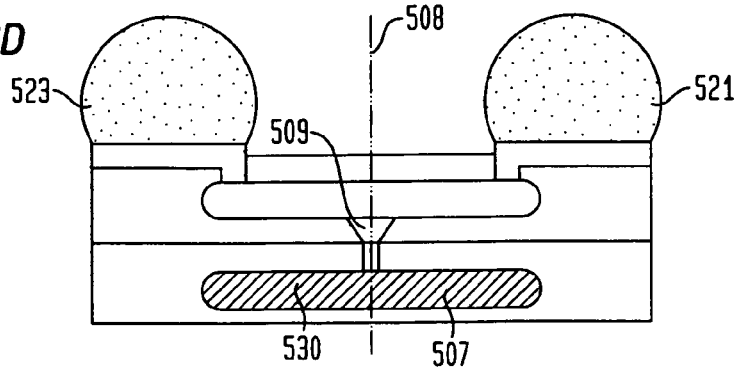
FIG. 8D is cross-sectional view of a switch according to FIG. 8A in a switch open position.
Figure 8E:
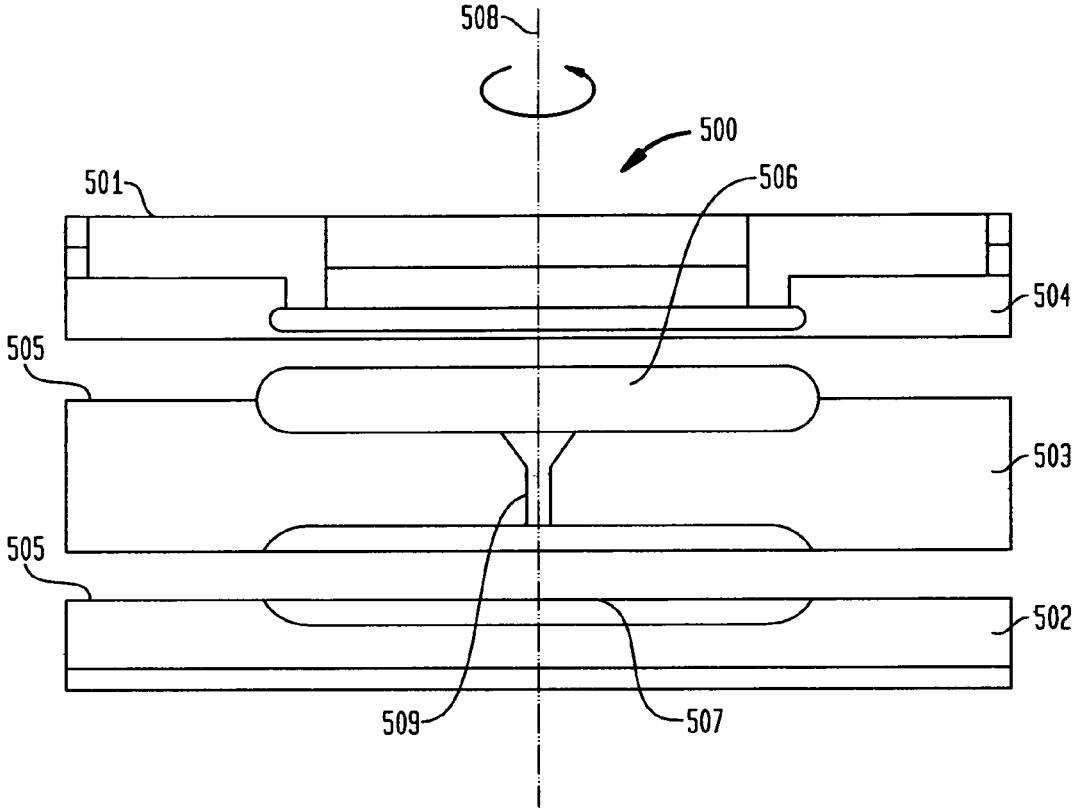
FIG. 8E is an exploded view of some of the elements included in the switch according to FIG. 8A.
Figure 9:
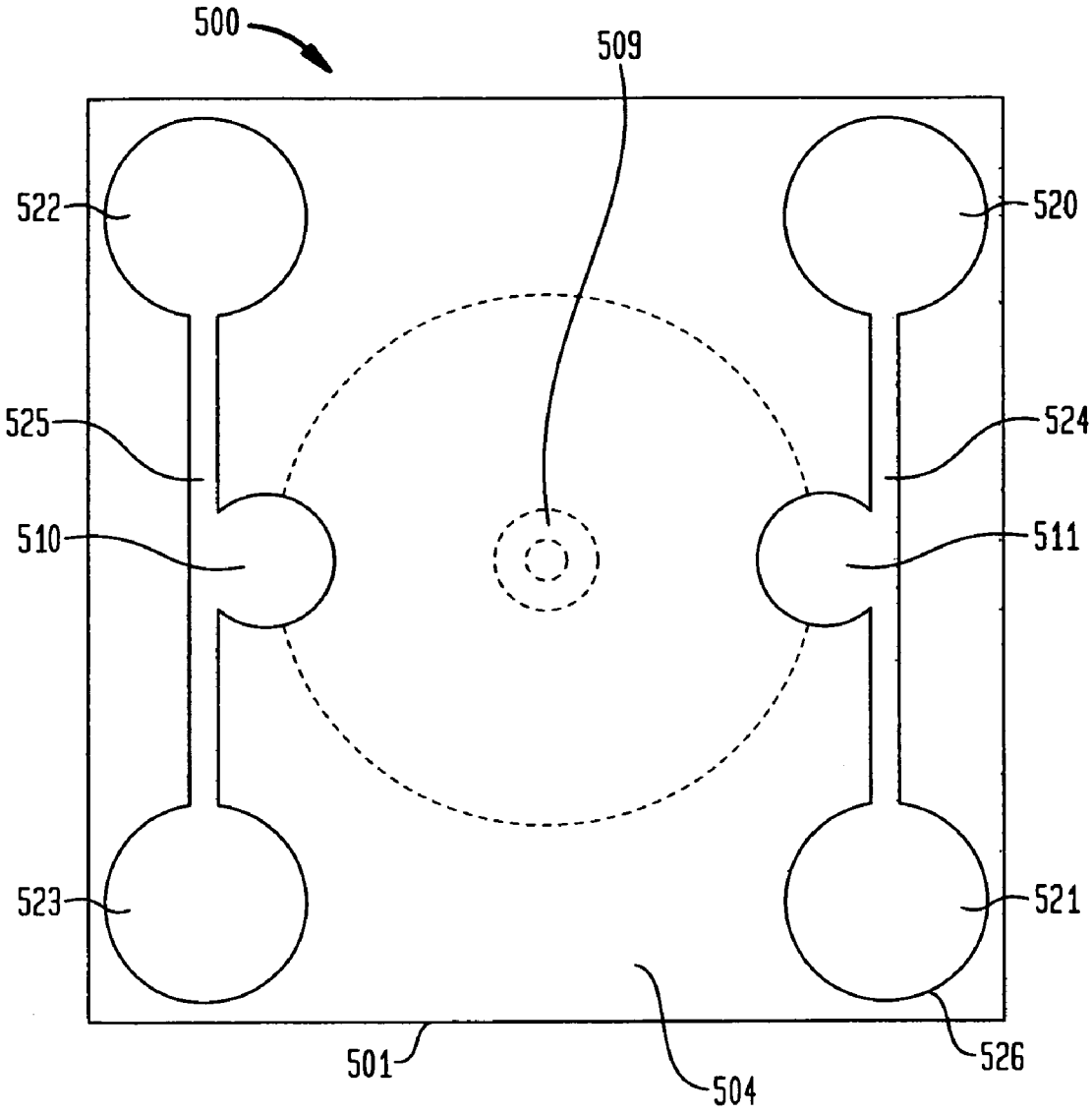
FIG. 9 is a rear plan view of some of elements included in the switch of FIG. 8A.

A switch 500 according to another embodiment of the invention is shown in FIGS. 8A-9. The switch according to this embodiment includes a housing 501. The housing includes a forward portion 502, central portion 503 and rear portion 504 overlying one another and bonded to one another as, for example, by an adhesive 505 (FIG. 8E). The rear portion 504 and central portion 503 cooperatively define a rearward chamber 506, so that the rear portion 504 constitutes the rearward wall of the chamber 506. The central portion 503 and the forward portion 502 cooperatively define a forward chamber 507.

Chambers 506 and 507 are substantially in the form of solids of revolution about a common axis 508. In the embodiment shown, each chamber is disc-like, with an axial dimension along common axis 508 substantially less than the diameter of the chamber (the dimension of the chamber perpendicular to axis 508). The forward chamber 507 has a volume equal to or greater than the volume of the rearward chamber 506. The central portion 503 of the housing defines an orifice 509 coaxial with the chambers and extending between the chambers.

Electrically conductive contact elements 510 and 511 are exposed at spaced-apart locations on the rearward wall of rearward chamber 506 defined by the rear portion 504 of the housing. Contact elements 510 and 511 are disposed remote from axis 508, near the periphery of the rearward chamber. In the embodiment depicted, the contact elements extend through apertures in the rear portion 504 of the housing.

The switch also includes terminals 520, 521, 522 and 523 exposed at an outer surface of housing 501 as, for example, on the rearward facing outer surface of housing rear portion 504. (FIG. 9) An electrically conductive trace 524 connects terminals 520 and 521 to contact element 511, whereas another electrically conductive trace 525 connects terminals 522 and 523 to contact element 510. Terminals 520-523 desirably are terminals adapted for surface mounting to a circuit panel as, for example terminals in the form of metallic pads. A conductive bonding material such as a solder 526 may be provided on the terminals for mounting to the circuit panel.

An electrically conductive liquid 530 such as mercury (Hg) is disposed within the housing. The volume of the electrically conductive liquid 530 desirably is slightly less than the volume of rearward chamber 506.

The switch is mounted in a projectile similar to the projectiles discussed above, with the axis 508 of the switch substantially coaxial with the forward-to-rearward axis of the projectile, and with the rear element 504 of the housing facing to the rear of the projectile. In the embodiment depicted, the four terminals 520-523 may be physically connected to four mating elements of a circuit panel (not shown). The four terminals provide a mechanically robust physical connection between the switch and the circuit panel.

The housing 501 desirably has lateral dimensions perpendicular to axis 508 of about 3 mm or less, and may have an axial dimension or thickness of about 2 mm or less. The elements of the housing, and the electrically conductive contact elements, traces and terminals may be fabricated using standard techniques commonly used in forming semiconductor chips.

For example, the elements of the housing may be fabricated in the form of a wafer including elements for numerous housings, and may be assembled to one another in this form. The conductive liquid may be introduced into the housings during the lamination step. The resulting wafer-level assembly may be severed to form individual units, each including one or more housings with the associated elements.

In operation, when the projectile is launched, the forward acceleration drives the conductive liquid 530 to the rear of the switch and thus brings the switch to the condition shown in FIG. 8A. In this closed condition, the conductive liquid forms a layer on the rear wall of the rear chamber, and thus covers both conductive elements 510 and 511. In this condition, the switch is closed, with terminals 520 and 521 electrically connected to terminals 522 and 523 through the conductive liquid.

During flight of the projectile, rotation of the projectile about axis 508 urges the conductive liquid radially outwardly, away from the axis. Gradual deceleration of the projectile during flight may cause some of the conductive liquid to flow forwardly. However, the rotation of the projectile maintains a continuous ring of conductive liquid around the periphery of the rear chamber 506, and thus maintains the switch closed as shown in FIG. 8B.

Upon impact of the projectile, the sudden deceleration in the forward direction forces the liquid forwardly within the rear chamber 506, thus rapidly breaking the connection with conductive elements 510 and 511 and opening the connection between terminals 520, 521 and terminals 522, 523. During deceleration upon impact, some or, more preferably, all of the liquid will pass into the forward chamber 507 through the orifice 509 as shown in FIG. 8C.

However, the switch will open before all of the liquid passes through the orifice. For example, the switch may open in about 10 μs or less. Once the liquid has been forced into the forward chamber 507, it will tend to remain in the forward chamber due to the surface tension of the liquid, and therefore will not tend to re-close the switch (FIG. 8D).

Moreover, even absent the effects of surface tensions the time required for the liquid to flow back into the rear chamber 506 after impact and possibly re-close the switch 500 will be far longer than the time required for the circuit to trigger the explosive charge in the projectile.

Figure 10A:
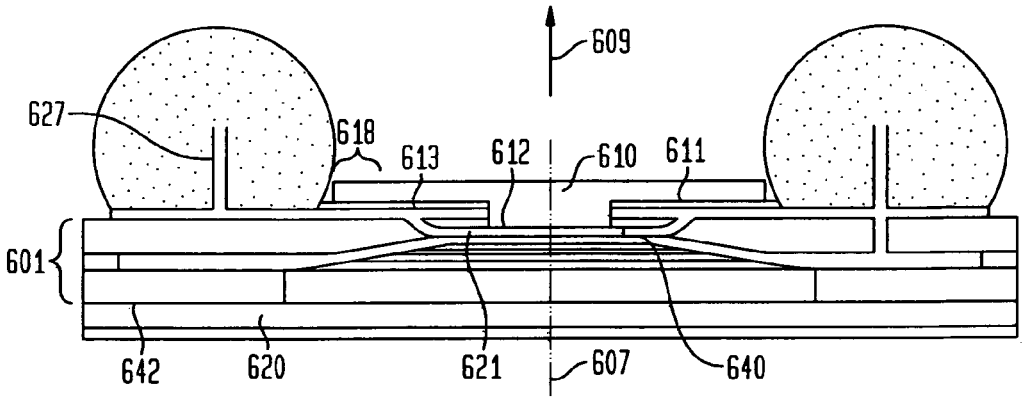
FIG. 10A is cross-sectional view of a switch according to one embodiment of the present invention in a switch closed position.
Figure 10B:
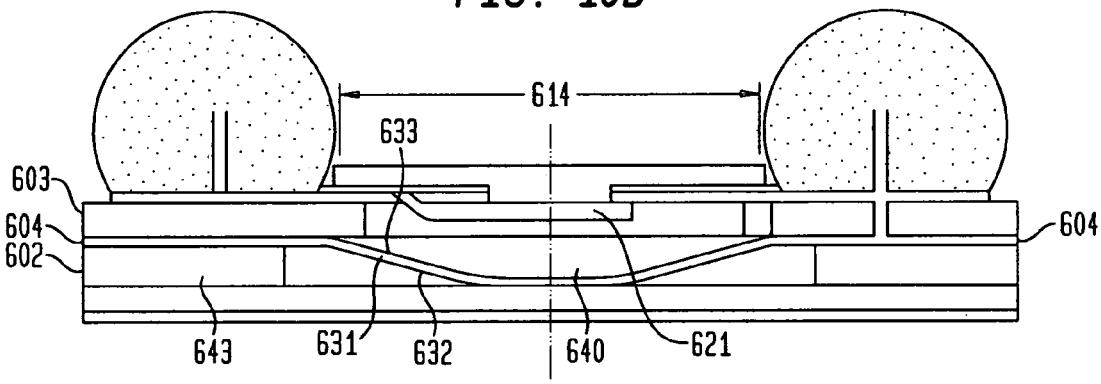
FIG. 10B is cross-sectional view of a switch according to FIG. 10A in a switch open tripped position.
Figure 10C:
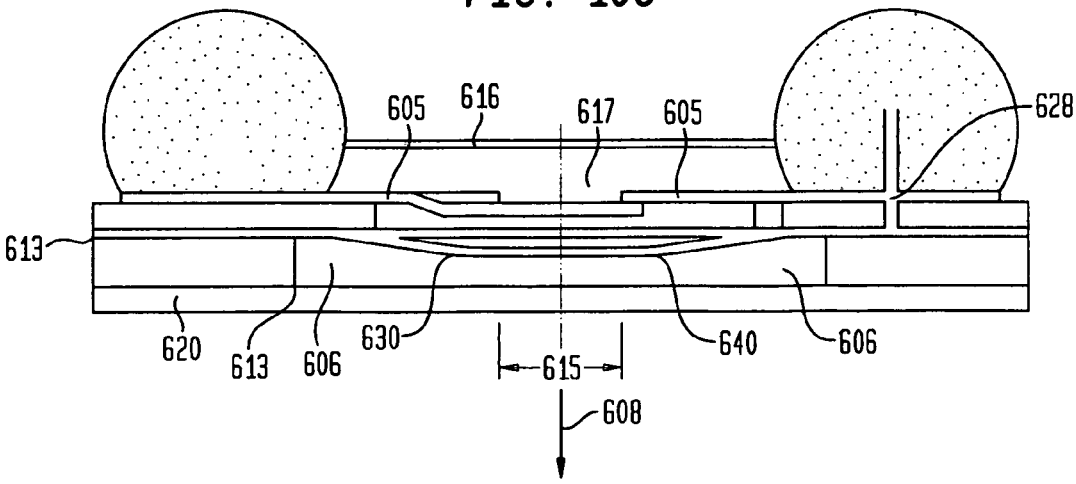
FIG. 10C is cross-sectional view of a switch according to FIG. 10A in a switch open normal position.
Figure 11:
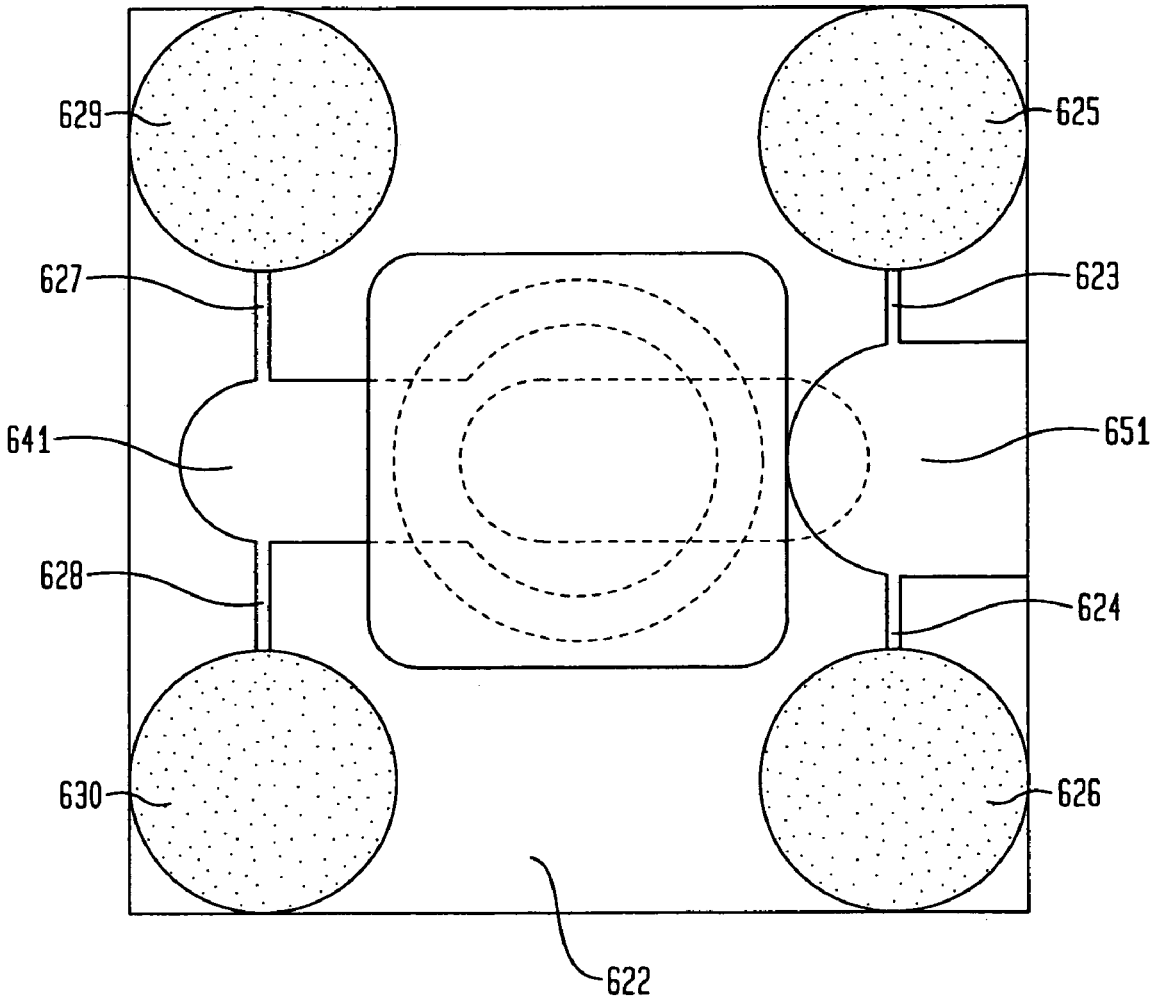
FIG. 11 is a rear plan view of some of the elements included in the switch of FIG. 10A.

A switch according to another embodiment of the invention is shown in FIGS. 10A-11. The switch according to this embodiment of includes a housing 601. The housing includes a forward portion 602 and a rearward portion 603 overlying one another and bonded to one another with, for example, an adhesive 604. The rearward portion and the forward portion cooperatively define a rearward chamber 605 and a forward chamber 606. In this embodiment, each chamber is substantially rectangular, with axial dimensions along common axis 607, substantially less than the length and width dimensions of the housing (the dimensions perpendicular to axis 607).

A rearward magnetic element 610 is a substantially circular disc having a rearward section 616 overlying the housing and a forward section 617 protruding in a forward direction indicated by arrow 608 into the housing. The rearward magnetic element 610 has forward facing surfaces 611 and 612. The peripheral region 618 of element 610 overlies and may be bonded to the housing, as for example, with adhesive 613 (FIG. 10A-C). The rearward section of the rearward magnetic element 616 has a diameter dimension 614 larger than the diameter dimension 615 of the forward section of the rearward magnetic element (the diameter dimensions being perpendicular to axis 607).

A forward magnetic element 620 overlies the forward portion 602 of the housing. The forward magnetic element 620 has a rearward face 642 as shown in FIG. 10A and may be adhesively bonded to the forward the facing surface of the housing (FIG. 10A-C). Magnetic elements 610 and 620 may be fabricated from carbon steel, however, any ferromagnetic material may be used. Magnetic elements 610 and 620 may be fabricated using conventional manufacturing processes such as molding, machining, casting and stamping.

A rearward contact 612 (FIG. 10A) is exposed in the rearward chamber and is attached to the forward face 621 of the rearward magnetic element 610, as for example, by adhesive bonding with an adhesive 613. The rearward contact extends laterally perpendicular to axis 607 and is connected to conductive region 641 as best seen in FIG. 11 on the rearward surface 622 of the housing. Conductive traces 627 and 628 connect conductive region 641 to terminals 629 and 630. Similarly, conductive traces 623 and 624 connect conductive region 651 to terminals 625 and 626 (FIG. 11). In this embodiment, the rearward contact 612 is comprised of gold foil but may be made of any other electrically conductive material such as silver or copper. The rearward contact 612 is stationary relative to the housing during operation of the switch.

A flexible magnetic membrane 630 (FIG. 10C) has a fixed peripheral portion attached to the housing. The fixed portion of the membrane is bonded between the forward portion 602 and the rearward portion 603 of the housing adhesive 613. The membrane 630 has a movable portion 631 including a forward surface 632 and a rearward surface 633. (FIGS. 10A-C) The membrane is ferromagnetic and has permanent magnetization. The flexible magnetic membrane may be formed from a composite material such as an elastomer, for example a silicone rubber, compounded with a permanent magnetic material such as NdFeB. Any type of flexible magnetic membrane may be used.

A mobile contact 640 is bonded to rearward surface 633 of the flexible membrane and is exposed in the housing. The mobile contact 640 is disposed forwardly of the rearward contact 612. The peripheral region 643 of the mobile contact 640 overlays the rearward facing surface of the forward portion 602 of the housing and is connected to the conductive region 651 disposed on the rearward surface 622 of the housing (FIG. 11). The mobile contact 640 may be comprised of gold foil but may be made of other conductive materials such as such as silver foil, copper foil and, for example, an electrically conductive polymer.

In this embodiment, the mobile contact 640 is essentially circular. The mobile contact is carried on the flexible membrane forwardly as indicated by arrow 608 or rearwardly as indicated by arrow 609 relative to the housing depending on forces acting on the switch.

The switch is mounted in a projectile (not shown) similar to the projectiles discussed above, with the axis 607 of the switch substantially coaxial with the forward-to-rearward axis of the projectile, and with the rear portion 603 of the housing facing to the rear of the projectile. In the embodiment depicted, the four terminals 625, 626, 629 and 630 (FIG. 11) may be physically connected to four mating elements of a circuit panel (not shown). The four terminals provide a mechanically robust physical connection between the switch and the circuit panel.

The housing may be formed from materials and have dimensions as discussed in the above detailed description.

The elements of the housing, and the electrically conductive contact elements, traces and terminals may be fabricated using standard techniques commonly used in forming semiconductor chips. For example, the elements of the housing may be fabricated in the form of a wafer including elements for numerous housings, and may be assembled to one another in this form. The magnetic elements, contacts and magnetic membranes may be introduced into the housings during the lamination step. The resulting wafer-level assembly may be cut to form individual units, each including one or more housings with the associated elements.

In operation, when the projectile is launched, the forward acceleration urges the movable portion 631 of the flexible magnetic membrane towards the rear of the switch. The membrane and the rearward magnetic element 620 are magnetically attracted to one another. Because the rearward magnetic element is stationary, the mobile contact 640 is carried rearwardly on the flexible magnetic membrane 630. The magnetic attraction between rearward magnetic element 620 and flexible magnetic membrane 630 holds the mobile contact 640 and the rearward contact 612 in electrical engagement with one another and brings the switch to the condition as shown in FIG. 10A. In this condition, the switch is closed, with terminals 625 and 626 electrically connected to terminals 629 and 630.

During flight of the projectile, deceleration forces in the forward direction and rotational forces in the radial direction perpendicular to the axis of the projectile are insufficient to overcome the attractive forces between the rearward magnetic element 620 and the flexible magnetic membrane 630. Thus, during flight, the mobile contact 640 and rearward contact 612 remain in electrical engagement with one another in the switch closed position (FIG. 10A).

Upon impact of the projectile, the sudden deceleration in the forward direction causes the flexible magnetic membrane 630 to move forwardly within the rear chamber 605, thus rapidly breaking the connection between the mobile contact and the rearward contact and opening the connection between terminals 625, 626 and terminals 629, 630.

During deceleration upon impact, the flexible magnetic membrane and mobile contact move rapidly out of rear chamber 605 and move into forward chamber 606. When the flexible magnetic membrane and mobile contact move toward the forward chamber 606, the flexible magnetic membrane is attracted to and held by the forward magnetic element 620 for a time sufficient for the circuit to fire the explosive charge in the projectile. Because the flexible magnetic membrane 630 carrying the mobile contact 640 and the forward magnetic element 620 are attracted to one another, the switch will not tend to re-close. (FIG. 10B) The switch may open in about 100 μs or less. Upon detection of a switch open condition for about 10 μs, or a predetermined delay time, the circuit triggers an explosive charge.

Moreover, even absent the effects of sufficient magnetic attraction between the magnetic membrane and the forward magnetic element after impact, the time required for mobile contact to move back into the rearward chamber after impact and possibly re-close the switch will be far longer than the time required for the circuit to fire the explosive charge in the projectile.

Under conditions of zero acceleration, the magnetic forces between the flexible magnetic membrane 630 and the forward and rearward magnetic elements 620, 610 are balanced such that the membrane is maintained in a neutral position as shown in FIG. 10C. In this position, because the mobile contact 640 is held away from the rearward contact 612 the switch remains open and terminals 625 and 626 are not electrically connected to terminals 629 and 630.

In a variation of the switch discussed above with reference to FIGS. 10A-11, the membrane may include a non-ferromagnetic flexible portion and a ferromagnetic slug disposed near the center of the membrane. The slug has permanent magnetization. The switch acts in the same manner as discussed above. The mobile contact may be carried on the slug.

In a further variant, the membrane or a slug carried on the membrane may be ferromagnetic but not permanently magnetized. The rearward magnetic element, forward magnetic element or slug may have permanent magnetization so that magnetic attraction holds the switch closed and then, after deceleration, holds the switch open. Also, the switch may have an additional fixed forward contact mounted on the forward magnetic element or the forward portion of the housing. The mobile contact may engage the additional contact after deceleration so that closure of the mobile contact with the additional contact provides a further normally open action which closes after deceleration.

In yet another variant, the rearward contact 612 is omitted and only the forward contact and mobile contact are used.

Figure 12A:
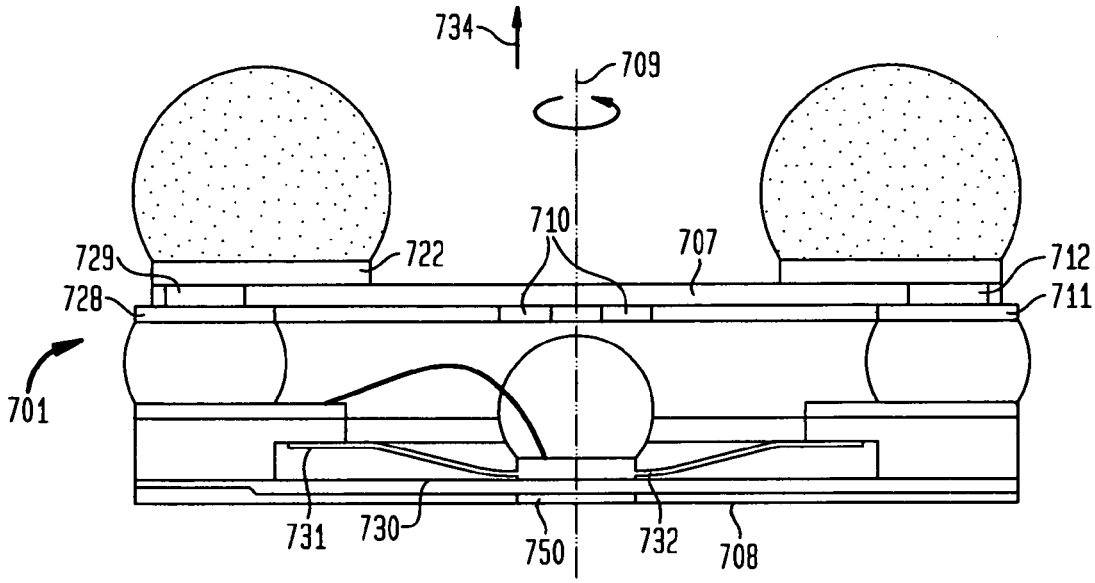
FIG. 12A is cross-sectional view of a switch according to one embodiment of the present invention in a switch open position.
Figure 12B:
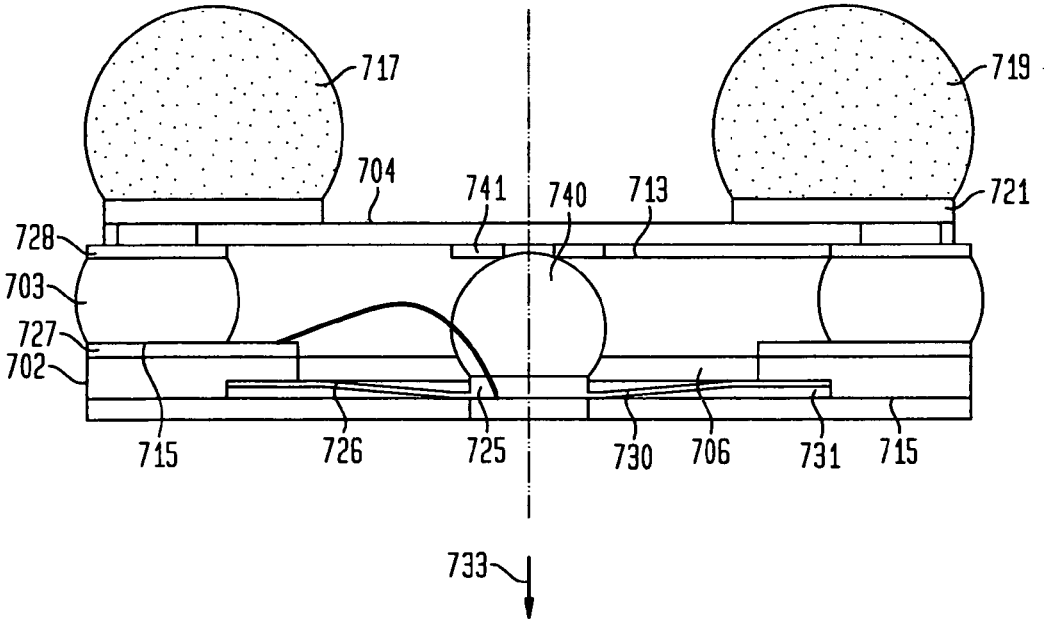
FIG. 12B is cross-sectional view of a switch according to FIG. 14A in a switch closed position.
Figure 13:
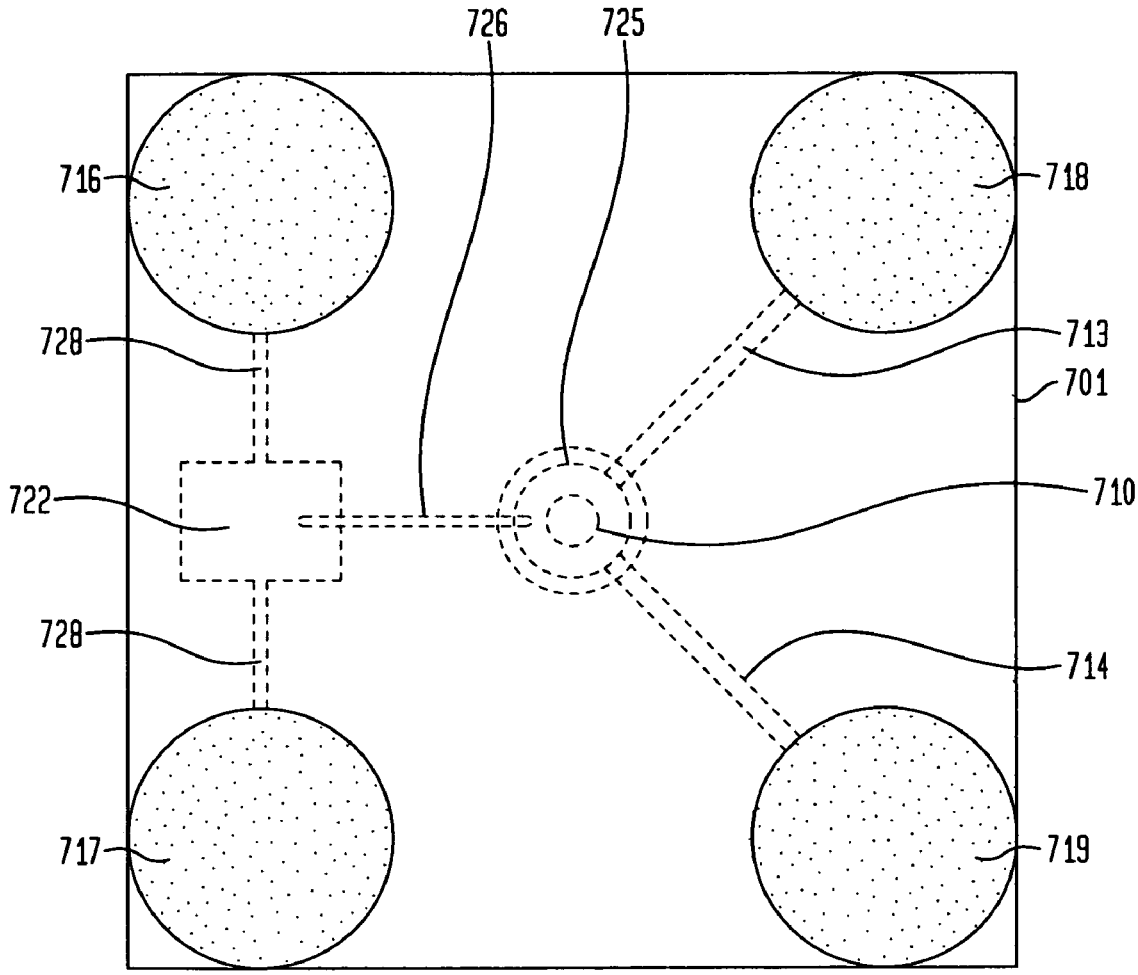
FIG. 13 is a rear plan view of some of the elements included in the switch of FIG. 11A.

A switch according to another embodiment of the invention is shown in FIGS. 12A-13. The switch according to this embodiment includes a housing 701. The housing includes a forward portion 702, a central portion 703 and a rear portion 704 overlying one another and bonded to one another as, for example, by an adhesive. The rear portion 704, the central portion 703 and the forward portion 702 cooperatively define a chamber 706, so that the forwardly facing surface of portion 704 constitutes the rearward wall 707 of the chamber and the rearward facing surface of the forward portion 702 constitutes the forward wall 708 of the chamber. The central portion 703 is a conductive material having a rearward conductive layer 711. Conductive layers 711, and 728 extend through apertures 712, and 729 respectively in the rear portion 704 of the housing and are electrically in contact with conductive regions 721 and 722.

A conductive layer 715 is disposed between the forward portion 702 and the central portion 703 of the housing. The chamber 706 is substantially in the form of a solid of revolution about a common axis 709. In the embodiment shown, the chamber is disc-like, with an axial dimension along common axis 709 substantially less than the diameter of the chamber (the dimension of the chamber perpendicular to axis 709).

An electrically conductive contact element 710 is exposed on the forward face of the rearward wall 707 of the chamber defined by the rear portion of the housing (FIG. 12A). The contact element 710 is disposed on rear wall 707 co-linear with the switch axis 709. Conductive wires 713 and 714 (FIG. 13) connect the contact 710 to the conductive layer 711. In this embodiment, the contact 710 is made of gold and is annular.

The switch includes a flexible membrane 730 having a fixed portion 731 and a movable portion 732. The fixed portion 731 is attached, as for example, with an adhesive to the forward portion of the housing. As shown in FIGS. 12A-B, the fixed portion of flexible membrane 730 is attached rearwardly of the forward wall 708 of the chamber and forwardly of the rearward contact 710 so that the membrane may move forwardly 733 and rearwardly 734 in the chamber. The flexible member 730 may be a flexible polymer film or an elastomeric compound such as a rubber.

An electrically conductive mobile contact element 725 is exposed in the forward portion of the chamber 706. The contact 725 may be made from gold and may be fabricated in the shape of a circular disc. In this embodiment, mobile contact 725 is disposed on the mobile portion 731 of the flexible membrane and is located co-axially with axis 709 and contact 710. The mobile contact may be attached, as for example, with adhesive the movable portion of the flexible membrane. A conductive wire 726 connects the mobile contact 725 to conductive layer 727 (FIG. 12A-B). Optionally, the wire may be a gold wire.

The switch also has a tacky adhesive region 750 disposed on the rearward facing surface of the forward wall 708 of the housing. In this embodiment, the tacky region is circular in shape and has substantially the same or slightly larger diameter as that of the mobile contact 725. The tacky adhesive region 750 is disposed such that when the mobile contact 725 is carried forwardly by the flexible membrane 730, the flexible membrane contacts and remains held in place by the tacky adhesive region 750. The tacky adhesive region may comprise an acrylic transfer adhesive film and other forms and formulations of tacky material such as epoxies, polyesters, tacky elastomers and combinations thereof. Mechanically tacky materials such as hook and loop devices may be used.

The switch includes terminals 716, 717, 718 and 719 exposed at an outer surface of housing 701 as, for example, on the rearward facing or outer surface of housing rear portion 704. (FIG. 13) Electrically conductive wires 713 and 714 connect terminals 718 and 719 to contact element 710 through conductive layer 711. Conductive wire 726 connects terminals 716 and 717 connect to contact element 725. Terminals 716-719 desirably are terminals adapted for surface mounting to a circuit panel as, for example terminals in the form of metallic pads. A conductive bonding material such as a solder may be provided on the terminals for mounting to the circuit panel.

The switch also includes an inertial body 740 having electrically a conductive surface 741 (FIGS. 12A-B). In this embodiment, the conductive surface 741 is formed as a coating on the inertial body 740 by conventional metallization methods such as plating, CVD and sputtering. The conductive surface 741 is made of an electrically conductive material such as copper, gold, silver, tungsten, conductive metallic oxides, nitrides or combinations thereof.

Alternatively, the inertial body 740 may be a uniform body of electrically conductive material such as a solder ball or other conductive metallic body. Desirably, the body has a spherical shape. The inertial body 740 is disposed in the cavity 706 between the contacts 710 and 725. The body 740 may be conductively attached to the mobile contact 725 being carried by the mobile contact on the flexible membrane 730 during operation of the switch.

The switch is mounted in a projectile similar to the projectiles discussed above, with the axis 709 of the switch substantially coaxial with the forward-to-rearward axis of the projectile, and with the rear element 704 of the housing facing to the rear of the projectile. Desirably, switch is mounted with axis 709 substantially co-linear with the forward to rearward axis of the projectile however, the switch may also be mounted adjacent to the axis.

The terminals provide a mechanically robust physical connection between the switch and the circuit panel, the housing may be formed from materials and have dimensions as discussed in the above description.

Under conditions of zero acceleration, the flexible membrane 730 urges the mobile contact 725 and the inertial body 740 rearward as shown in FIG. 12B.

In this position, because the mobile contact 725 and the inertial body 740 are held in contact with the rearward contact 710 the switch is closed and terminals 716 and 717 are electrically connected to terminals 719 and 720 through the contacts and the inertial body.

In operation, when the projectile is launched and during flight, forward acceleration of the projectile drives the inertial body to the rear of the switch and maintains the switch closed condition as discussed above.

Gradual deceleration of the projectile during flight does not cause the switch to open because the flexible membrane 730 continues to urge the mobile contact 725 and the inertial body 740 rearwardly into electrical engagement with the rearward contact 710.

Upon impact of the projectile, the sudden deceleration in the forward direction 733 forces the inertial body forwardly within the chamber 706, thus rapidly breaking the connection between the conductive elements 710 and 725 thus opening the connection between terminals 716, 717 and 719, 720 (FIG. 12A).

During deceleration, a portion of the flexible membrane 730 will adhere to the tacky region 750 thus holding contact 710 apart from contact 725 and maintaining the switch in the open condition. However, the switch will open before flexible membrane adheres to the tacky region. For example, the switch may open in about 100 μs or less. Once the membrane has been forced into contact with the tacky region it will tend to remain adhered, and therefore will not tend to re-close the switch. (FIG. 12A)

Even absent the effects of the tacky adhesive region, the time required for the inertial body 740 to re-contact the rearward contact 710 after impact and possibly re-close the switch will be far longer than the time required for the circuit to trigger the explosive charge in the projectile.

Figure 14A:
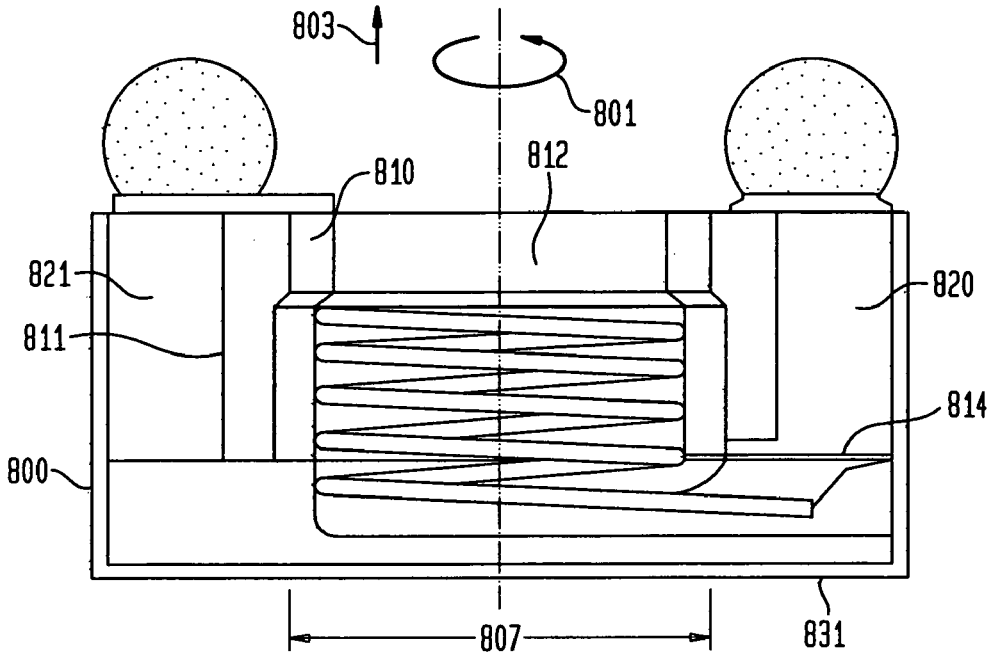
FIG. 14A is cross-sectional view of a switch according to one embodiment of the present invention in a switch open position.
Figure 14B:
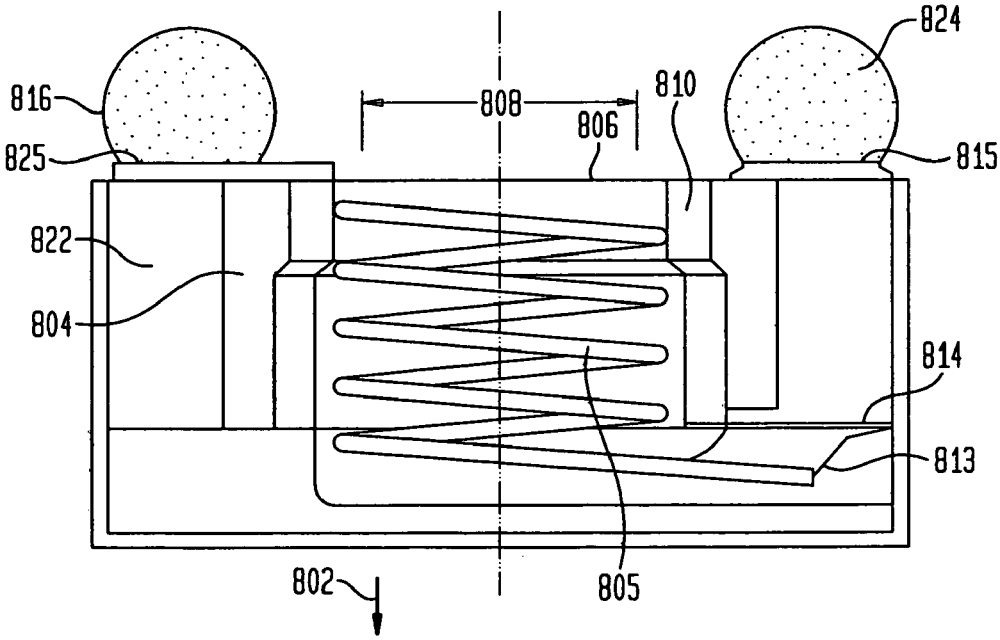
FIG. 14B is cross-sectional view of a switch according to FIG. 14A in a switch closed position.
Figure 15:
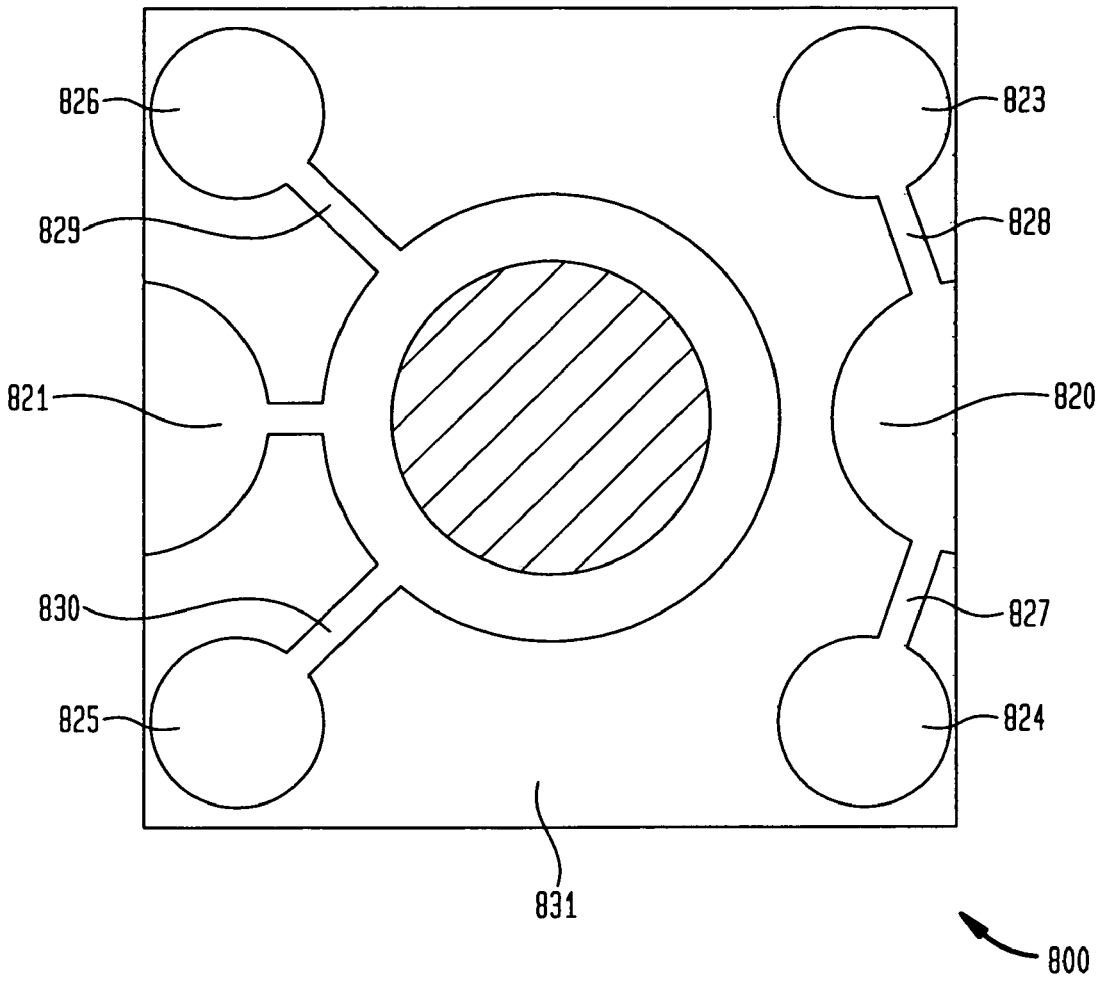
FIG. 15 is a rear plan view of some of the elements included in the switch of FIG. 14A.

A switch according to another embodiment of the invention is shown in FIGS. 14A-15. The switch includes a structure 800 having axis 801 extending in forward direction 802 and rearward direction 803. The structure 800 includes walls 804 defining a cylindrical forward chamber 805 and a cylindrical rearward chamber 806, which communicates with the forward chamber. Chambers 805 and 806 are coaxial with one another and with axis 801.

Chambers 805 and 806 have are diameters 807 and 808 respectively in the direction perpendicular to axis 801 (FIGS. 14A-B). In this embodiment, the diameter 807 of the forward chamber is larger than the diameter 806 of the rearward chamber. Although the chambers are shown as being substantially cylindrical, different shaped chambers may be utilized.

The structure 800 includes vias 820 and 821 which are formed using conventional chemical or mechanical material removal methods such as chemical etching or mechanical machining. Numerous structures and vias can be fabricated as portions of a silicon wafer. Vias 820 and 821 are formed in the shape of a half circle (FIG. 15) although other shapes may be used.

Vias 820 and 821 (FIG. 14A) are filled with a conductive material 822 which overlies the structure in regions 814, 815 and 816 (FIG. 14B). Conductive material 822 may comprise conductive material such as copper, silver, gold and solder.

A first contact element 810 is exposed in the rearward chamber 806 and forms at least a portion of the wall of the chamber 806. FIGS. 14A-B depicts the contact element 810 as a continuous ring coated with conductive material.

The contact 810 may comprise a metallic ring or a non-metallic ring coated with metallic layer or layers such as copper, tungsten, gold, silver or platinum conductive metal oxides, nitrides and combinations thereof. Optionally, the ring has a substantially corrosion resistant surface such as a layer of gold. Contact element 810 may be formed by manufacturing techniques used in production of semi conductor wafers such as machining, masking, etching, chemical vapor deposition (CVD), sputtering and selective plating.

A second contact element 812 is disposed in the forward chamber 805 and extends partially into rearward chamber 806. In this embodiment, the second contact 812 is a conductive coil spring. The spring 812 is slightly compressed so that it bears against the first ring contact 810. Optionally, the second contact 812 is a gold plated steel spring. The second contact 812 is disposed in the forward and rearward chambers substantially coaxial with axis 801 of the switch. The forward facing end of the spring 812 is bonded with conductive adhesive 813 to conductive layer 814. Layer 814 electrically connects the spring contact to the conductive material 822 in via 820. Alternatively, contact 812 may be soldered to conductive region 814. In the switch closed condition shown in FIG. 14B, the second contact 812 bears on the first contact 810 and electrically connects to contact 810.

A circular dielectric element 811 overlies the forward facing end surface of the ring 810. The dielectric element electrically isolates the rearward chamber 806 from the forward chamber 805. The dielectric element 811 may be structurally bonded between the forward and rearward chambers and has a diameter smaller than the diameter 808 of rearward chamber 806. The dielectric element 811 may be an electrically non-conductive material such as a fiberglass composite or a polyimide film.

The switch includes terminals 823, 824, 825 and 826 exposed at an outer surface of structure 800 as, for example, on the rearward facing or outer facing surface 831 of the switch. (FIG. 15) The conductive material 822 electrically communicates with terminals 823-826 through conductive traces 827-830 disposed on the rearward facing surface 831 of the structure. (FIG. 15) Electrically conductive traces 827 and 828 connect terminals 823 and 824 to the spring contact element 812. Electrically conductive traces 829 and 830 connect terminals 825 and 826 to the ring contact element 810. Terminals 823-826 desirably are terminals adapted for surface mounting to a circuit panel as, for example terminals in the form of metallic pads. A conductive bonding material such as a solder may be provided on the terminals for mounting to the circuit panel.

The elements of the structure, and the electrically conductive contact elements, traces and terminals may be fabricated using standard techniques commonly used in forming semiconductor chips as discussed above.

In this embodiment, the switch is mounted in a projectile similar to the projectiles discussed above. Desirably, the switch is mounted with axis 801 substantially co-linear with the forward to rearward axis of the projectile however, the switch may also be mounted adjacent to the axis. The switch is mounted with the rear surface 831 of the structure 800 facing to the rear of the projectile.

Under conditions of zero acceleration, the switch is in a closed condition as shown in FIG. 14B. Because the conductive spring is compressed and bears on the ring surface the switch remains closed and terminals 823 and 824 are electrically connected to terminals 825 and 826.

In operation, when the projectile is launched and during its flight, the forward acceleration and rotation of the projectile does not overcome the compressive forces holding the spring in contact with the first contact, thus the switch remains in the condition as shown in FIG. 14B. In this condition, switch is closed, with terminals 823 and 824 electrically connected to terminals 825 and 826 via a current path through the ring contact 810 and the spring contact 812.

Gradual deceleration of the projectile during flight does not cause the switch to open because the compression and lateral growth of the spring contact prevents it from moving into the forward chamber 805 and maintains the switch in a closed position as shown in FIG. 14B. Because the spring contact 812 is compressed, it tends to expand and frictionally engages the ring contact 810. Since the contact area is relatively small, high frictional pressure is achieved. This geometry allows for a stable electrical connection between the contacts 810 and 812 in the switch-closed position and for irreversible separation of and electrical isolation between the contacts upon sudden deceleration of the switch in the forward direction as indicated by arrow 802.

Upon impact of the projectile, the sudden deceleration in the forward direction drives the spring contact irreversibly into the forward chamber 805 as shown in FIG. 14A, thus rapidly breaking the connection between the spring contact and the ring contact and opening the connection between terminals 823, 824 and terminals 825, 826.

The switch may open in about 100 μs or less. As explained below, once the spring contact has moved into the forward chamber, it becomes trapped in the forward chamber and renter the rearward chamber and re-closes the switch.

Because the spring expands to fill the diameter of the forward chamber 805 and the dielectric element 811 has a smaller diameter than the rearward chamber 806, the spring 812 will bear on the wall of the lateral walls of the forward chamber and the forward face of the dielectric element thus preventing reentry into the rearward chamber and re-contact with the ring contact.

Even absent the effects of the trapping geometry, the time required for the spring to re-contact the ring contact after impact and possibly re-close the switch will be far longer than the time required for the circuit to fire the explosive charge in the projectile.

Figure 16:
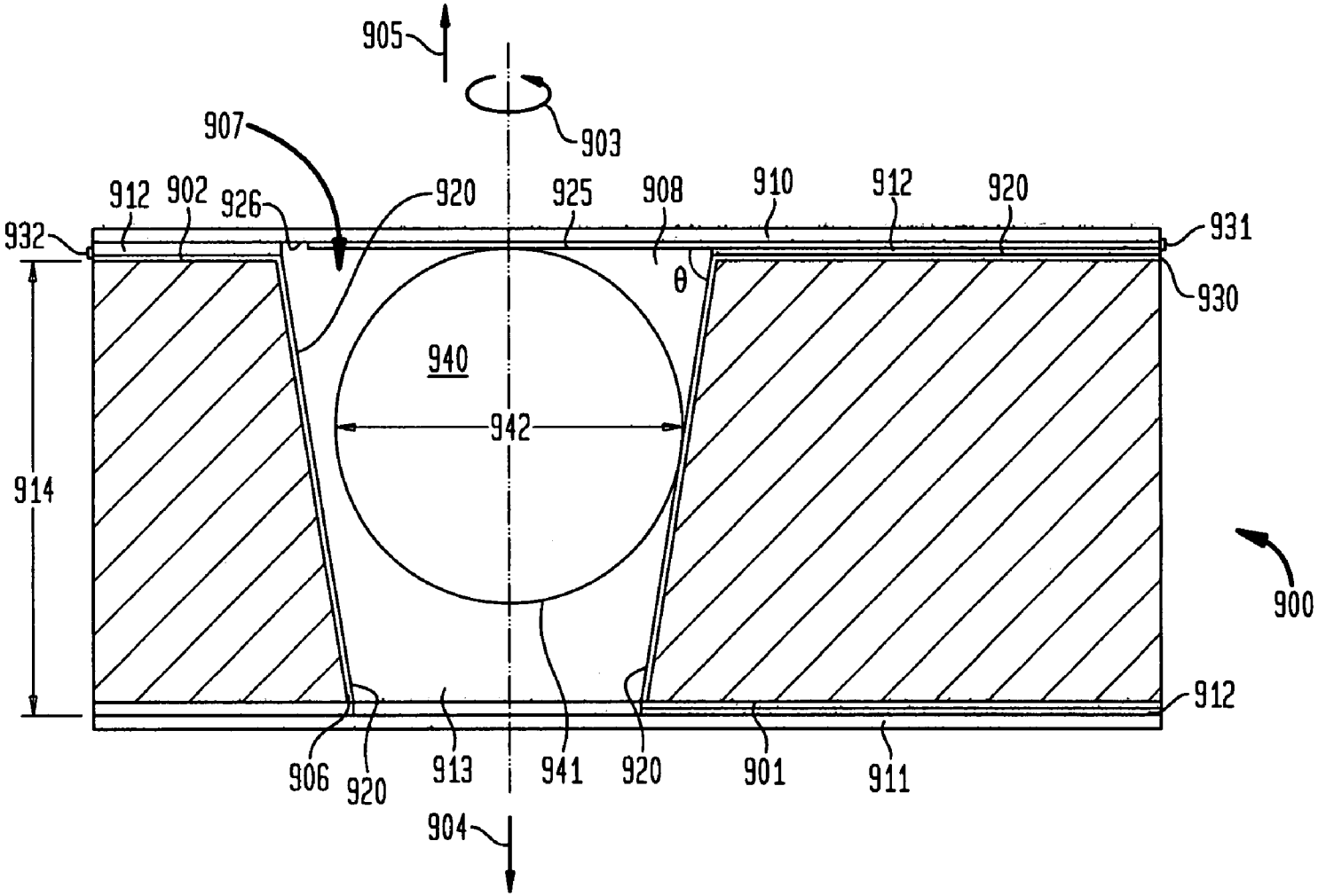
FIG. 16 is cross-sectional view of a switch according to one embodiment of the present invention in a switch closed position.
Figure 17:
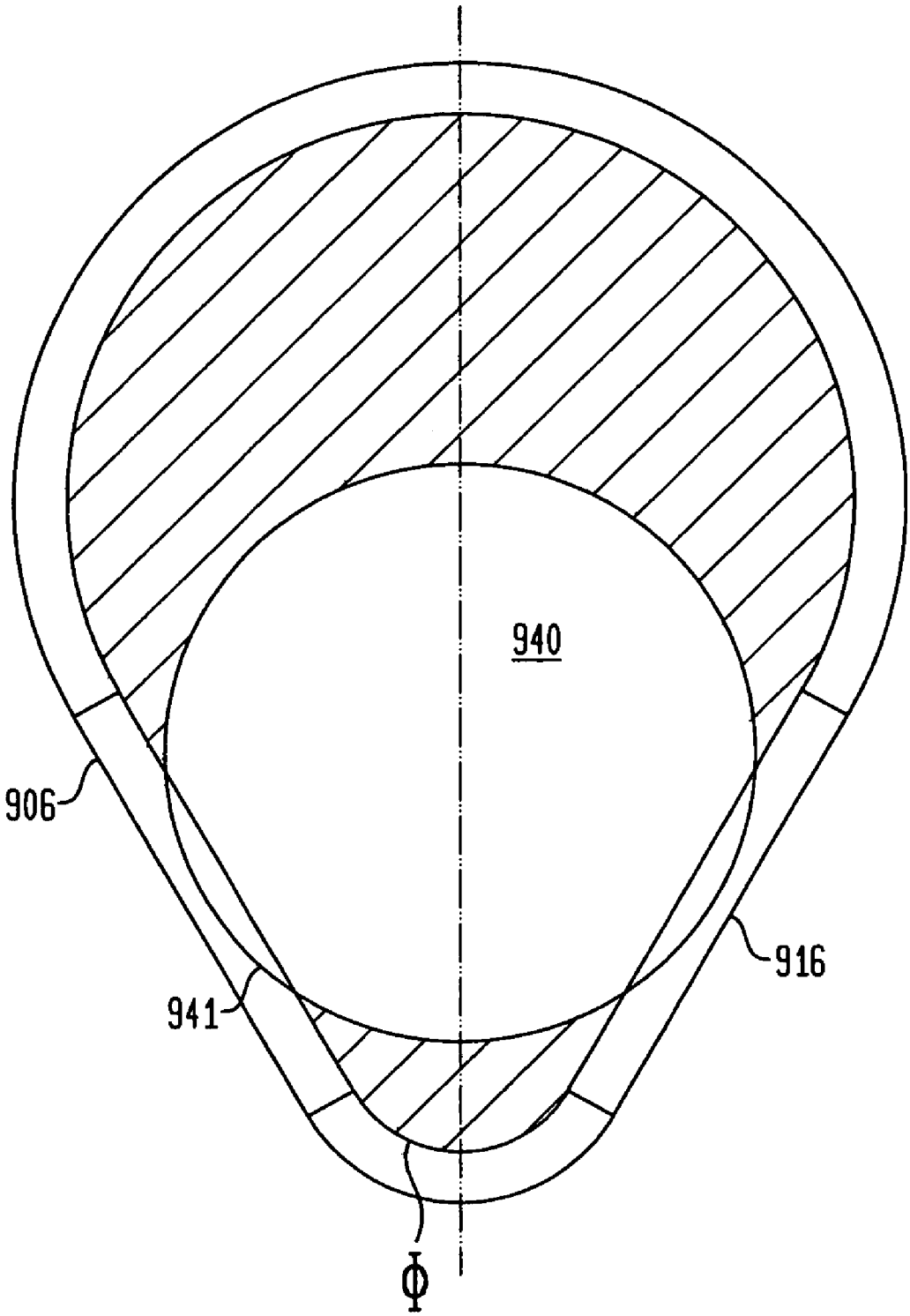
FIG. 17 is top plan view of a switch according to FIG. 16.

A switch according to another embodiment of the invention is shown in FIGS. 16-17. The switch includes a housing 900. The housing has a forward surface 901, a rearward surface 902, and an axis 903 extending forwardly 904 and rearwardly 905. The housing also has first sidewall 906 and second sidewall 916 defining a tapered aperture 907. Tapered aperture 907 has wide end 908 facing in rearward direction 905 and away from forward direction 904. The aperture 907 is open to the forward surface 901 and the rearward surface 902 of the housing 900.

Housing 900 includes rear cover 910 and front cover 911. The rear cover 910 overlays the rear surface 902 of the housing 900 and is attached to the housing, as for example, with an adhesive material 912 thus sealing the wide end 908 of the aperture 907. Similarly, the front cover 911 overlays the front surface 901 of the housing 900 and is attached to the housing, as for example, with adhesive material 912 thus sealing the narrow end 913 of the aperture 907.

In this embodiment, tapered aperture 907 has a first side wall 906 sloping away from axis 903 in rearward direction 905. A first angle θ is formed between side wall 906 and rear cover 910 (FIG. 16). The angle θ may be between about sixty and about 90 degrees. Desirably, the angle θ is between about eighty and about eighty-nine degrees.

Tapered aperture 907 also has a second side wall 916 sloping away from axis 903 in rearward direction 905 (FIG. 17). A second angle ϕ is formed between first side wall 906 and second side wall 916 in a plane perpendicular to axis 903 (FIG. 17). The angle $\phi$ is between about fifteen and about forty-five degrees. Desirably, the angle $\phi$ is between about fifteen and about thirty degrees.

Aperture 907 is formed in housing 900 using conventional chemical or mechanical material removal methods discussed above. Preferably, housing 900 has dimensions about 2 millimeters or less in forward to rearward thickness dimension 914 and is no larger than about 3 millimeters in the length and width dimensions.

Advantages of this configuration include ease of assembly, reduced fabrication costs and sealing of the switch to prevent entry of contamination that may impede the function of the switch. The housing desirably is fabricated from a semiconductor chip. Preferably, housing and cover materials have similar linear coefficients of thermal expansion to minimize internal stress under changing temperature conditions and to maintain the dimensional stability of the switch. Optionally, the front and rear covers of the housing are fabricated from a semiconductor chip but the covers may be any rigid non-conductive material such as a glass-reinforced circuit board or similar composite material.

In this embodiment walls 906 and 916 include conductive contact element 920. A first contact 920 is a conductive layer disposed on walls and rearward surface 902 of the housing. A second contact 925 is disposed on the forward facing surface 926 of cover 910. Contact 925 overlies a portion of aperture 907 and is spaced apart and electrically isolated from contact 920. Contacts 920 and 925 may comprise a metallic layer or layers such as copper, tungsten, gold, silver, platinum, conductive metal oxides and nitrides and combinations thereof. Contacts 920 and 925 may be formed by manufacturing techniques used in production of semi-conductor wafers such as masking, etching, chemical vapor deposition (CVD), sputtering and selective plating.

Conductive terminals 930, 931 and 932 are attached to the first and second contacts as depicted in FIG. 16. The terminals may be attached to the contacts at any convenient location. Desirably, the terminals are located near the periphery of the housing 900 and outside of tapered aperture 907. Any number of terminals may be utilized at any location on contacts 920 and 925.

The switch also includes an inertial body 940 having an electrically conductive surface 941. (FIGS. 16-17) In this embodiment, the conductive surface 941 is formed as a coating on the inertial body 940 by conventional metallization methods such as plating, CVD and sputtering. The conductive surface 941 on inertial body 940 is made of an electrically conductive material such as copper, gold, silver, tungsten, conductive metallic oxides, nitrides or combinations thereof. Alternatively, inertial body 940 may be a uniform body of electrically conductive material. The inertial body 940 is disposed in the tapered aperture 908 of the housing 900. Desirably, the inertial body 940 has a substantially spherical shape and has a diameter dimension 942 larger than the narrow end 913 of the aperture 907.

The elements of the housing, the electrically conductive contact elements, and terminals may be fabricated using standard techniques as discussed above.

In the embodiment depicted, the three terminals 930, 931 and 932 (FIG. 16) may be physically connected to three mating elements of a circuit panel (not shown).

The switch is mounted in a projectile similar to the projectiles discussed above, with the axis 903 of the switch spaced apart from the forward-to-rearward axis of the projectile, and with the rear cover 910 of the switch facing to the rear of the projectile.

In operation, when the projectile is launched, forward acceleration drives the inertial body to the rear of the switch and thus brings the switch to the condition shown in FIG. 16. Rotation of the switch about axis 903 forces the inertial body 940 rearwardly 905 into engagement with the contacts 920 and 925. Due to centrifugal acceleration acting on the inertial body, the body will tend to become wedged between walls 906 and 916 (FIG. 17) and between walls 906 and cover 910 (FIG. 16). In this closed condition, the conductive surface 941 of the inertial body contacts both conductive elements 920 and 925 and the switch is closed, with terminals 930 and 932 electrically connected to terminal 931.

Gradual deceleration of the projectile during flight will not cause the inertial body to move forwardly. Because of the unique angular geometry of the tapered aperture, the rotation of the projectile holds the body 940 between walls 906 and 916, and between wall 906 and rear covers 910, thus maintains the switch closed as shown in FIG. 16.

Upon impact of the projectile, the sudden deceleration in the forward direction forces the inertial body 940 forward 904 within the aperture 907, thus rapidly breaking the connection with conductive elements 920 and 925 and opening the connection between terminals 930, 932 and terminal 931. During deceleration upon impact, the inertial body moves towards the narrow forward end of the aperture 913 and away from rearward contact 925. The switch may open in about 100 μs or less. Once the inertial body has been forced towards the narrow end of the aperture, it may remain wedged in a position away from contact 925 due to frictional engagement with the walls of the housing. Therefore, the switch will not tend to re-close.

Moreover, even absent the effects of the geometry of the aperture and inertial body, the time required for the body to move rearwardly after impact and possibly re-close the switch will be far longer than the time required for the circuit to fire the explosive charge in the projectile.

Figure 18:
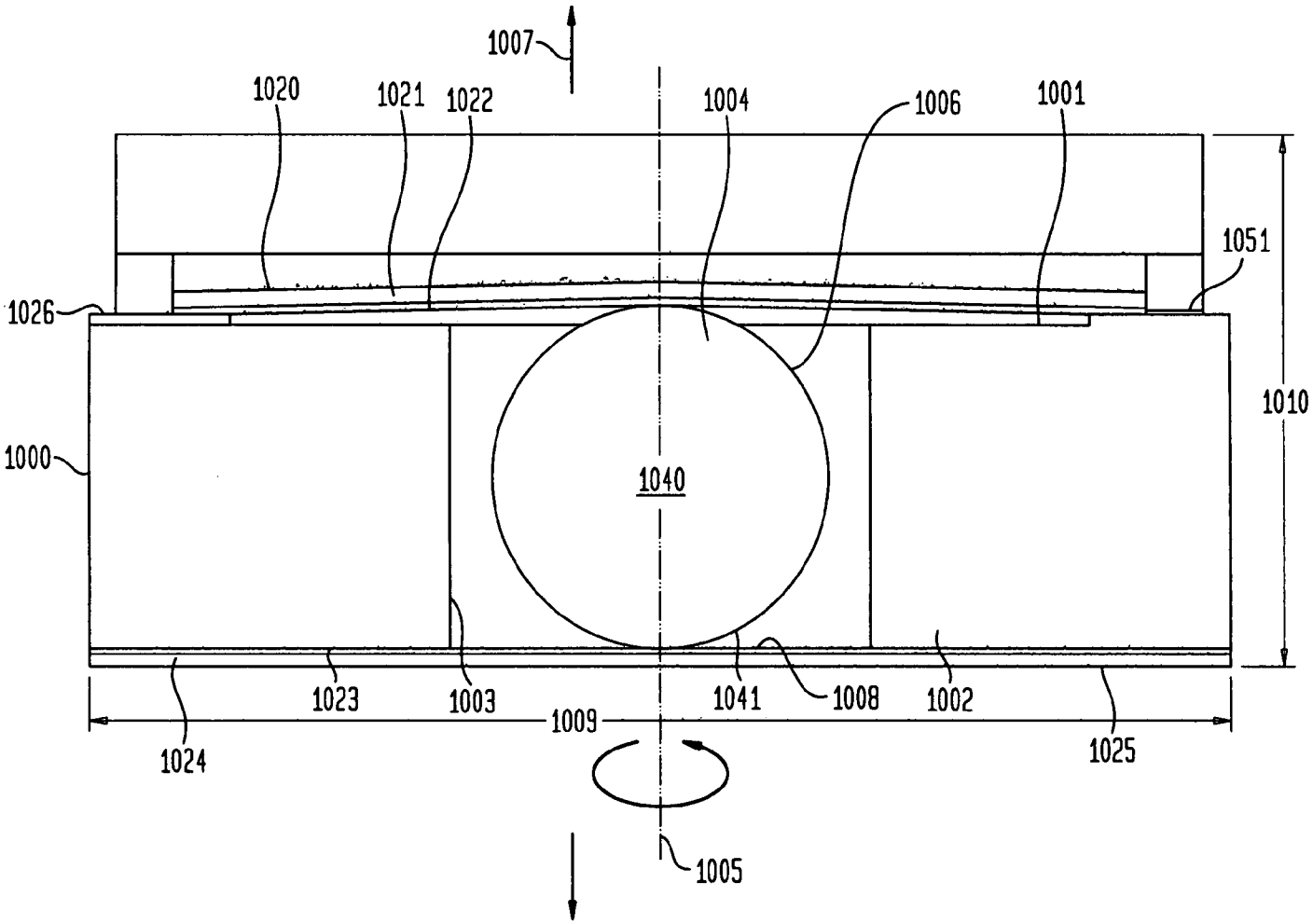
FIG. 18 is cross-sectional view of a switch according to one embodiment of the present invention in a switch closed position.
Figure 19:
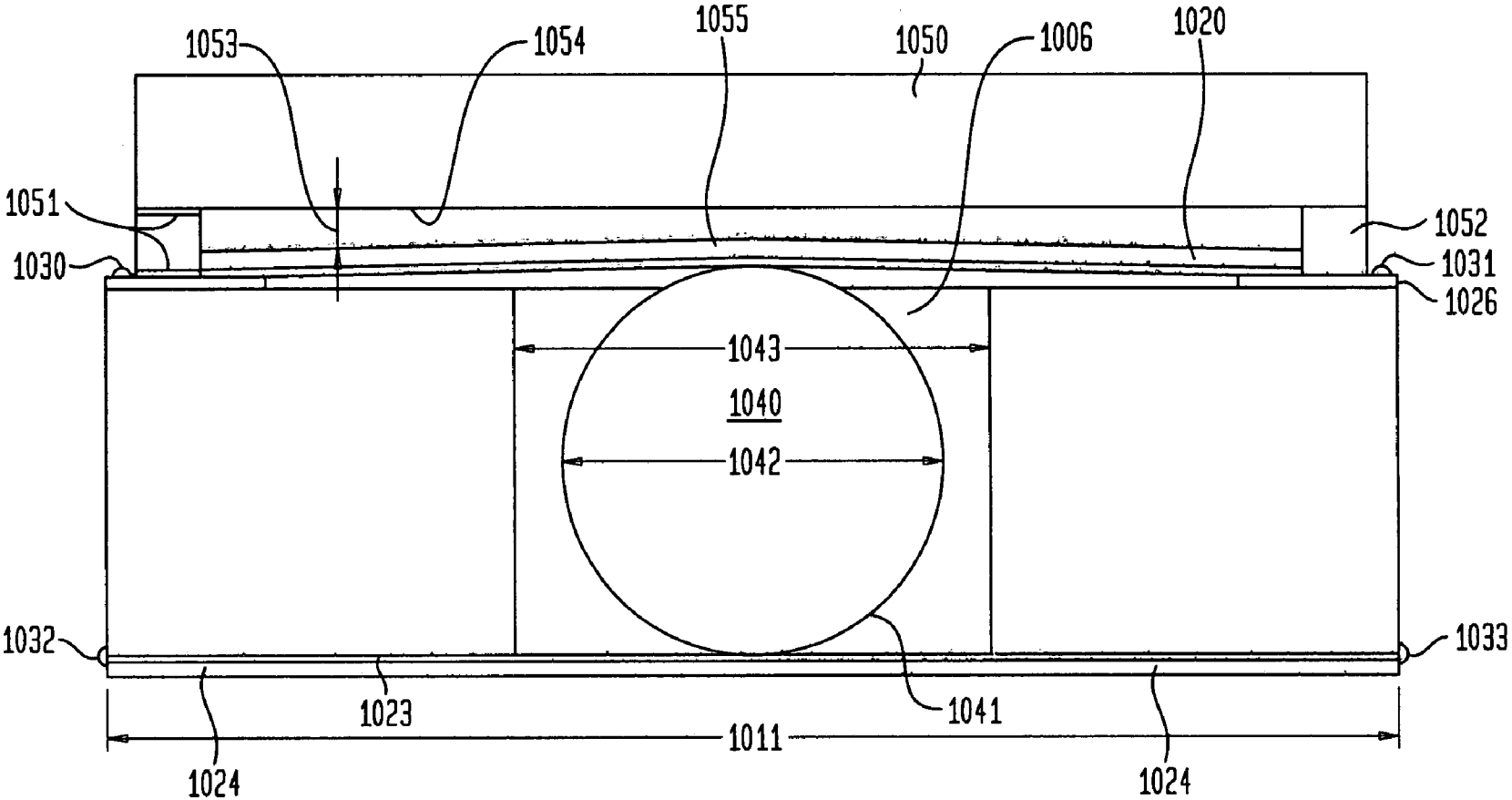
FIG. 19 is a plan view of a switch according FIG. 18.

A switch in accordance with one embodiment of the present invention as shown in FIGS. 18 and 19 includes a housing 1000. The housing has a forward surface 1001 and a rearward surface 1002. The housing also has a substantially vertical wall 1003 which defines a circular aperture 1004 and is defined by a cylindrical surface of revolution coaxial with the forward to rearward axis 1005. The aperture has a forward end 1006 facing in a forward direction 1007 and a rear end 1008 facing in a rearward direction 1009. The ends of the aperture 1004 are open to the oppositely faced forward and rearward surfaces of the housing.

Housing 1000 is fabricated from a material such as a semiconductor or glass reinforced circuit board or similar composite material. Aperture 1004 is formed in the housing conventional chemical or mechanical material removal methods such as chemical etching or mechanical machining. For example, numerous housings can be fabricated as portions of a silicon wafer.

Preferably, housing 1000 has dimensions about 2 millimeters or less in forward to rearward thickness dimension 1010 and is no larger than about 3 millimeters in the length dimension 1011 and width dimension (dimensions perpendicular to axis 1005). In this embodiment, the aperture 1004 has curved walls 1003 forming the surface of a cylinder.

A first resilient conductive element 1020 overlies the forward facing end of the aperture and is attached to the front face of the housing. The resilient contact element 1020 may be a deformable membrane comprising a polymeric sheet 1021 facing forwardly 1007 attached to a conductive metallic foil 1022, such as gold or silver foil, facing rearwardly 1009.

Similarly, a second conductive contact 1023 overlies the rearward facing end of the aperture and is attached to the rearward face 1002 of the housing 1000. The second conductive element includes a conductive layer 1024 such as copper and a rigid layer 1025 such as a non-conductive composite laminate or semiconductor material covering the rearward surface of the housing.

Conductive region 1026 is disposed on the forward facing surface 1001 of the housing 1000 and is electrically connected to the resilient conductive element 1020. Region 1026 and layer 1024 may be formed by standard manufacturing techniques as discussed above.

In a preferred geometry, region 1026 covers the periphery of the forward facing surface 1001 of the housing and extends inwardly towards the aperture to provide a conductive path between resilient conductive element 1020 and conductive region 1026. Desirably, terminals 1030 and 1031 are bonded with a conductive adhesive to region 1026 at any convenient location on the housing. Preferably, the terminals 1030, 1031 are located near the periphery of the housing.

Similarly, terminals 1032 and 1033 are attached to conductive layer 1024. Any number of terminals may be mounted at any location on region 1026 and conductive layer 1024.

The switch also includes an inertial body 1040 having an electrically conductive surface 1041. In this embodiment, conductive surface 1041 is formed as a coating on inertial body 1040 by conventional metallization methods such as plating, CVD and sputtering. Conductive surface 1041 on inertial body 1040 is made of an electrically conductive material such as copper, gold, silver, tungsten, conductive metallic oxides, nitrides or combinations thereof. Alternatively, inertial body 1040 may be a uniform body of electrically conductive material such as copper.

In this embodiment, the inertial body is substantially spherical. The inertial body 1040 is disposed in the aperture 1004. The diameter 1042 of the body is slightly smaller than the diameter 1043 of the aperture. This geometry allows the body 1040 to move forwardly 1007 within the aperture upon sudden deceleration in the forward direction while minimizing the lateral movement of the body within the aperture in the radial direction perpendicular to the axis 1005.

In this embodiment, the switch includes a lid 1050. The lid 1050 is fabricated from a rigid solid material such that the lid covers the forward end 1006 of the aperture 1004. Preferably, the lid 1050 is made of a glass and is attached to housing 1000 with a suitable adhesive such as a structural epoxy, or silicone. As shown in FIGS. 18-19 the lid 1050 is mounted to the housing 1000 with an adhesive 1051 on a gasket 1052. The gasket 1052 is bonded to housing 1000 thus creating a cover over the forward end of the aperture 1004 and forming a gap 1053 between the rearward surface 1054 of the lid 1050 and the forward facing surface 1055 of the resilient contact 1020.

In this embodiment, the switch is mounted in a projectile similar to the projectiles discussed. Desirably, the switch is mounted with axis 1005 substantially co-linear with the forward to rearward axis of the projectile however; the switch may be mounted adjacent to the axis. The switch is mounted with the rear surface 1002 of the housing 1000 facing to the rear of the projectile.

Under conditions of zero acceleration, the switch is in a closed condition as shown in FIGS. 18-19. In this condition, the resilient contact 1020 urges the inertial body 1040 rearwardly into engagement with the conductive layer 1024 of the second contact. Because the resilient contact holds the inertial body in contact with second contact, the switch is closed and terminals 1030 and 1031 are electrically connected to terminals 1032 and 1033.

In operation, when the projectile is launched and during flight, the forward acceleration of the projectile drives the inertial body to the rear of the switch and maintains the switch in the condition shown in FIGS. 18-19. In this condition, switch is remains closed, with terminals 1030 and 1031 electrically connected to terminals 1032 and 1033 via a current path through the conductive region, the resilient contact, the inertial body and the second contact.

Gradual deceleration of the projectile during flight does not cause the switch to open because the resilient contact urges the inertial body rearwardly into engagement with the second contact maintaining a switch closed condition.

The geometry described above comprising a spherical inertial body disposed in a slightly larger cylindrical aperture prevents the body from moving laterally perpendicular to the switch axis due to rotation of the projectile and maintains the switch in a closed position under conditions of severe acceleration in a direction transverse the switch axis 1005.

Upon impact of the projectile, the sudden deceleration in the forward direction forces the inertial body forwardly 1007 deforming the resilient contact 1020, thus rapidly breaking the connection between the inertial body 1040 and the second contact 1023 and opening the connection between terminals 1030, 1031 and terminals 1032, 1033. The gap 1053 allows sufficient space for forward displacement of the resilient contact and inertial body away from contact 1023 upon sufficient deceleration of housing 1000 in forward direction, thereby opening the switch.

The switch may open in about 100 μs or less. Once the inertial body has deformed the resilient contact and moved forwardly in the aperture, it will not tend to re-close the switch until well before the time required for the circuit to fire the explosive charge in the projectile.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A switch comprising:

(a) a housing having a wall defining a tapered aperture having a wide end facing in a forward direction, at least a portion of said housing being fabricated as a portion of a silicon wafer, the housing having a forward to rearward dimension of about 2 millimeters or less, and said wall including at least two electrically conductive contact elements spaced apart from one another; and (b) an inertial body having a conductive surface, said inertial body being disposed in said tapered aperture, said inertial body engaging said contact elements and electrically connecting said contact elements to one another in a switch closed condition, said inertial body being dislodged from engagement with at least one of said contact elements upon deceleration of said housing in a forward direction.

2. A projectile including a projectile body having a forward end, a switch as claimed in claim 1 mounted to said body with said wide end of said aperture facing toward the forward end of said body, and a circuit mounted to said body and electrically connected to said switch.

3. A projectile as claimed in claim 2 further comprising an explosive charge, said circuit being operative to trigger said explosive charge upon opening of said switch.

4. A projectile as claimed in claim 2 wherein said projectile body has a longitudinal axis extending forwardly and rearwardly, said projectile being adapted to rotate about said longitudinal axis during flight, said switch being disposed adjacent said longitudinal axis.

5. A switch as claimed in claim 1 further comprising a first flexible member mechanically connected to said housing and bearing on said inertial body so that said first flexible member urges said inertial body rearwardly into engagement with said contact elements.

6. A switch as claimed in claim 1 further comprising a plurality of flexible members mechanically connected to said housing and bearing on said inertial body so that said plurality of flexible members urges said inertial body rearwardly into engagement with said contact elements.

7. A switch as claimed in claim 1 further comprising a lid, said lid sealingly engaging said wide end of said housing.

8. A switch as claimed in claim 1 wherein said tapered aperture has flat sides.

9. A method for triggering a device comprising;

(a) accelerating a switch comprising a housing, and a conductive mass disposed between at least two contacts within said housing, at least a portion of said housing being fabricated as a portion of a silicon wafer, and the housing having a forward to rearward dimension of about 2 millimeters or less;

(b) forming an electrical path through said conductive mass and between said at least two contacts;

(c) decelerating said switch;

(d) interrupting said electrical path; and (e) triggering said device.

* * * * *